US006127033A

United States Patent [19]

Kinlen et al.

[11] Patent Number: 6,127,033

[45] Date of Patent: Oct. 3, 2000

[54] SOLVENT SPINNING OF FIBERS CONTAINING AN INTRINSICALLY CONDUCTIVE POLYMER

[76] Inventors: Patrick J. Kinlen, 1348 Remington Oak Ter., Fenton, Mo. 63026; Bruce G. Frushour, 1509 Lynkirk Dr., St. Louis, Mo. 63122

[21] Appl. No.: 09/179,802

[22] Filed: Oct. 27, 1998

Related U.S. Application Data

[62] Division of application No. 08/917,660, Aug. 25, 1997, Pat. No. 5,911,930.

[51] Int. Cl.[7] ..... D02G 3/00; H01B 1/00

[52] U.S. Cl. ..... 428/364; 428/373; 252/500; 525/185; 525/186

[58] Field of Search ..... 428/364, 372, 428/373; 252/500; 525/185, 186

[56] References Cited

U.S. PATENT DOCUMENTS

| | | | |
|---|---|---|---|
| 2,577,763 | 12/1951 | Hoxie . | |
| 2,744,086 | 5/1956 | Mewry et al. . | |
| 2,749,325 | 6/1956 | Craig et al. . | |
| 2,916,348 | 12/1959 | Cresswell . | |
| 3,052,512 | 9/1962 | Kocay et al. . | |
| 3,124,629 | 3/1964 | Knudsen . | |
| 4,803,096 | 2/1989 | Kuhn et al. . | |
| 4,913,867 | 4/1990 | Epstein et al. . | |
| 4,935,181 | 6/1990 | Theophilou et al. . | |
| 5,030,508 | 7/1991 | Kuhn et al. . | |
| 5,135,696 | 8/1992 | Epstein et al. . | |
| 5,162,135 | 11/1992 | Gregory et al. . | |
| 5,171,478 | 12/1992 | Han . | |
| 5,177,187 | 1/1993 | MacDiarmid et al. . | |
| 5,258,472 | 11/1993 | MacDiarmid et al. . | |
| 5,284,554 | 2/1994 | Datta et al. . | |
| 5,290,483 | 3/1994 | Kulkarni et al. . | |
| 5,292,573 | 3/1994 | Adams, Jr. et al. . | |
| 5,294,694 | 3/1994 | Epstein et al. . | |
| 5,312,686 | 5/1994 | MacDiarmid et al. . | |
| 5,381,149 | 1/1995 | Doughterty et al. . | |
| 5,403,913 | 4/1995 | MacDiarmid et al. . | |
| 5,423,956 | 6/1995 | White et al. . | |
| 5,458,968 | 10/1995 | Bittle et al. . | |
| 5,463,014 | 10/1995 | Epstein et al. . | |
| 5,470,505 | 11/1995 | Smith et al. . | |
| 5,563,182 | 10/1996 | Epstein et al. . | |
| 5,567,356 | 10/1996 | Kinlen . | |
| 5,840,214 | 11/1998 | Kinlen | 252/500 |
| 5,863,465 | 1/1999 | Kinlen | 252/500 |
| 5,871,671 | 2/1999 | Kinlen et al. | 252/500 |
| 5,908,898 | 6/1999 | Wan-Cheng et al. | 525/185 |

FOREIGN PATENT DOCUMENTS

| | | |
|---|---|---|
| 0 446943 (A2) | 9/1991 | European Pat. Off. . |
| WO 90/03102 | 3/1990 | WIPO . |

OTHER PUBLICATIONS

Electronically–conductive Fibers of Polyaniline Spun from Solutions in Concentrated Sulfuric Acid, by Andreatta, Cao, Chiang, Heeger and Smith. *Synthetic Metals*, 26 (1988) 383–389.

(List continued on next page.)

*Primary Examiner*—N. Edwards
*Attorney, Agent, or Firm*—Howell & Haferkamp, L.C.

[57] ABSTRACT

A fiber containing an organic acid salt of an intrinsically conductive polymer distributed throughout a matrix polymer is provided along with a method for producing such fibers by spinning a solution which includes an organic acid salt of an intrinsically conductive polymer, a matrix polymer and a spinning solvent into a coagulation bath comprising a non-solvent for both the organic acid salt of an intrinsically conductive polymer and the matrix polymer. The intrinsically conductive polymer-containing fibers typically have electrical conductivities below about $10^{-5}$ S/cm.

11 Claims, 10 Drawing Sheets

(2 of 10 Drawing Sheet(s) Filed in Color)

OTHER PUBLICATIONS

Improved Solution Stability and Spinnability of Concentrated Polyaniline Solutions Using N,N Dimethyl Propylene Urea as the Spin Bath Solvent, by Tzou and Gregory. *Synthetic Metals*, 69 (1995) 109–112.

Preparation of Polyaniline Free Standing Film by Controlled Processing and its Transport Property by Jeong, Suh, Oh, Park, Kim and MacDiarmid. *Synthetic Metals*, 69 (1995) 171–172.

Solution Processable Conducting Polymer: Polyaniline Polyelectrolyte Complexes, by Sun and Lang. *Materials research Society*, vol. 328 (1994) 209–214.

Microwave Properties of Conductive Polymers, by Olmedo, Hourquebie and Jousse. *Synthetic Metals*, 69 (1995) 205–208.

Electrically Conductive Polymer Blends Comprising Polyaniline, by Terlemezyan, Mihallov, and Ivanova. *Polymer Bulletin*, 29 (1992) 283–287.

Counter–Ion Induced Processibility of Conducting Polyaniline and of Conducting Polyblends of Polyaniline in Bulk Polymers, by Cao, Smith and Heeger. *Synthetic Metals*, 48 (1992) 91–97.

Polyaniline Blends in Thermoplastics, by Shacklette, Han and Luly. *Synthetic Metals*, 1992.

Wet–spinning Technology, by Capone. *Acrylic Fiber Technology and Applications*, (1995) 69–103.

TEM and WAXS Characterization of Polyaniline/Fibers, by Passiniemi, Laakso, Osterholm, and Pohl. *Synthetic Metals*, 84 (1997) 775–776.

Electrically Conductive Compositions Based on Processible Polyanilines—PANIPOL, by Virtanen, Laakso, Ruohoned, Vakiparta, Jarvinen, Jussila, Passiniemi and Osterholm *Synthetic Metals*, 84 (1997) 113–114.

SOLVENT SPINNING OF FIBERS CONTAINING AN INTRINSICALLY CONDUCTIVE POLYMER

This is a division of Application Ser. No. 08/917,660, filed Aug. 25, 1997, now U.S. Pat. No. 5,911,930.

BACKGROUND OF THE INVENTION (1) Field of the Invention

The present invention relates generally to the preparation of textile fibers, and more particularly to the preparation of fibers containing an intrinsically conductive polymer (ICP) by solution spinning.

(2) Description of Related Art

Several ICP's, one notable example of which is polyaniline, are recognized as being promising for applications which require the properties of a polymer, but would benefit from enhanced electrical or electromagnetic properties. Nevertheless, the use of polyaniline in its protonated, or conductive form, has been limited because it has been considered difficult to process due to low solubility in normal commercial solvents. The low solubility of polyaniline compositions have precluded their use in producing fibers by solution spinning or wet spinning because standard wet spinning methods require a polymer concentration of 15 to 20 percent in the spinning solution.

Recently, new methods for the preparation of fibers containing conductive forms of polyaniline have been reported. Methods to coat fibers by electrochemically forming a conductive organic polymer on the outer surface of a polymeric fiber were reported in U.S. Pat. No. 5,423,956. Similarly, polyaniline with a counterion doping agent has been polymerized onto the surface of a fiber or fabric material. (See U.S. Pat. No. 4,803,096). These and other processes that polymerize polyaniline on the surface of fibers or textiles have the drawbacks of requiring additional manufacturing steps and result in the ICP being limited to the surface of the fiber rather than distributed throughout the fiber cross-section.

Another approach described by Hsu in U.S. Pat. No. 5,248,554, impregnates filaments of p-aramid yarns with polyaniline by passing the yarn through a solution of polyaniline in concentrated sulfuric acid. The acid causes the fiber to swell and crack longitudinally allowing the polyaniline to penetrate into the fiber. Although the method results in the penetration of polyaniline into the fiber interior, the process results in loss of strength of the fiber and can not provide a fiber containing polyaniline doped with larger organic acids since the larger acids can not diffuse into the fiber after the polyaniline impregnation.

Andreatta and coworkers report a method of producing polyaniline fibers from a solution in concentrated sulfuric acid (Andreatta et al., *Synth. Metals*, 26:383–389, 1988) and Epstein and Yue report spinning fibers of sulfonated polyaniline from solutions in sulfuric acid or sodium hydroxide (U.S. Pat. No. 5,135,696). However, fibers composed entirely of polyaniline are brittle and inflexible and unable to withstand the wear and tear of textile use. Neither of these groups disclosed the spinning of fibers from polymer blends containing polyaniline, presumably because polymers typically used in textile fibers are either insoluble or unstable in the acids or caustic solutions required by the method.

Smith et al., U.S. Pat. No. 5,470,505, also reported spinning polyaniline fibers having high conductivity from a concentrated sulfuric acid solution into a bath of chilled water. The group used the same method to spin fibers from a 1:1 mixture of polyaniline and poly-para(phenylene terephthalamide) (Kevlar®), but reported no blends with more commonly used fiber-forming polymers and disclosed no tensile properties for the resulting fibers. Furthermore, the use of organic acid salts of an ICP was not taught, presumably because the sulfuric acid would have replaced the organic acid dopant during the spinning process.

High molecular weight polyaniline has also been spun into fibers from the non-conductive form of polyaniline dissolved in N-methyl pyrrolidone followed by subsequent doping of the fibers with HCl to produce the conductive form of polyaniline (See, for example, U.S. Pat. Nos. 5,177,187, 5,258,472 and 5,312,686 to MacDiarmid et al.). However, a solution of polyaniline in NMP is unstable and gels rapidly at room temperature. Although Han, U.S. Pat. No. 5,171,478, reported spinning fibers of neutral polyaniline in NMP from a "blue solid rubber-like gel", followed by redoping in paratoluenesulfonic acid, it is doubtful that such high viscosity materials could be easily handled in commercial scale processes.

Tzou, K. T. and R. V. Gregory, *Synth. Metals*, 69:109–112, 1995, report that a solution of neutral, undoped polyaniline in N,N'-dimethyl propylene urea is more stable than NMP as a spinning solvent. Also, Cohen et al., EPO 446,943 A2, 1991, spun polyaniline fibers from concentrated solutions (20%) using solvents such as 1,4 diaminocyclohexane and 1,5-diazabicyclo(4,3,0)-non-5-ene, but such solutions are very sensitive to shear rates applied during mixing. Furthermore, as noted above, fibers produced from polyaniline alone are unsuitable for most textile applications. Also, post-spinning doping to increase polyaniline conductivity results in doping only the surface of the fibers and usually requires that small dopant molecules (e.g., HCl) be used so that doping time will not be prohibitively long. But these small dopants easily diffuse out of a fiber during washing, for example, leaving it undoped. Also, such doping requires a separate and additional processing step which increases the complexity and cost of manufacture. Dopants of larger molecular size, such as certain organic acids, would have the advantage of being less prone to diffuse out of the doped fiber, but, conversely, could not be added to the fiber after its formation without unreasonably long diffusion time or partial destruction of the fiber structure.

In another approach, polyaniline with a counterion doping agent has been polymerized onto the surface of a fiber or fabric material (See U.S. Pat. No. 4,803,096 to Kuhn et al.). But this method also results in the dopant being restricted to the surface of the fibers.

Furthermore, achieving an adequate adhesion of a surface coating of an ICP to the host fiber can be a problem.

Cao et al., *Synth. Metals*, 48:91–97, 1992, cast films of doped polyaniline blended with polymers such as polymethylmethacrylate and polyethylene, but do not disclose how fibers may be formed by conventional fiber spinning techniques. This is understandable inasmuch as the technology used for film formation is different than that used for fiber spinning and systems of polymers and solvents useful for film forming may not be useful at all for fiber spinning.

Thus it would be desirable to provide fibers which contain an ICP, such as polyaniline, doped with an organic acid and in its electrically conductive form, that is dispersed in the fiber and which also possess the mechanical properties which permit their successful use in textile materials. It would additionally be desirable to provide an improved method for producing such fibers.

SUMMARY OF THE INVENTION

Accordingly, the inventors have succeeded in devising a new method for preparing fibers containing an ICP. The method comprises mixing in a spinning solution an organic acid salt of an intrinsically conductive polymer (ICP salt), a matrix polymer and an organic solvent in which the ICP and the matrix polymer are substantially soluble and extruding the spinning solution from a spinneret into a coagulation bath containing a nonsolvent wherein the nonsolvent is comprised of a liquid in which the matrix polymer and the ICP salt are substantially insoluble.

In another embodiment of the present invention, the inventors provide a fiber containing an ICP salt dispersed in a matrix polymer. The fibers of the present invention have mechanical properties suitable for use in forming textile materials, i.e., fabrics made from fibers. For example, such fibers have a tenacity equal to or greater than about 1.0 g/denier. In one variation of this embodiment, the ICP salt is in a conductive form, whereas the fiber as a whole is non-conductive. By electrically conductive, it is meant that the conductivity of the polymer is greater than $10^{-8}$ S/cm and preferably greater than $10^{-5}$ S/cm. By non-conductive, it is meant that the conductivity of the polymer is less than $10^{-5}$ S/cm and preferably less than $10^{-8}$ S/cm.

In accordance with another embodiment of the invention, a fiber containing an ICP is provided which is prepared by a process comprising: mixing in a spinning solution an ICP salt and an organic solvent and extruding the spinning solution from a spinneret into a coagulation bath containing a nonsolvent wherein the nonsolvent is comprised of a liquid in which the matrix polymer and the organic acid salt of the intrinsically conductive polymer are substantially insoluble. Among the several advantages found to be achieved by the present invention, therefore, may be noted the provision of a simple and inexpensive method for spinning a fiber containing an ICP salt, which method readily lends itself to commercial fiber spinning technology and equipment; the provision of a fiber made by this method; the provision of a fiber which contains an ICP in its protonated form and that has mechanical properties suitable for use in textile materials; and the provision of a fiber containing a dopant that is dispersed throughout the fiber and that does not easily diffuse out of the fiber during washing.

BRIEF DESCRIPTION OF THE DRAWINGS

The file of this patent contains at least one drawing executed in color. Copies of this patent with color drawings will be provided by the Patent and Trademark Office upon request and payment of the necessary fee.

DETAILED DESCRIPTION OF THE PREFERRED EMBODIMENTS

Figure 1A:
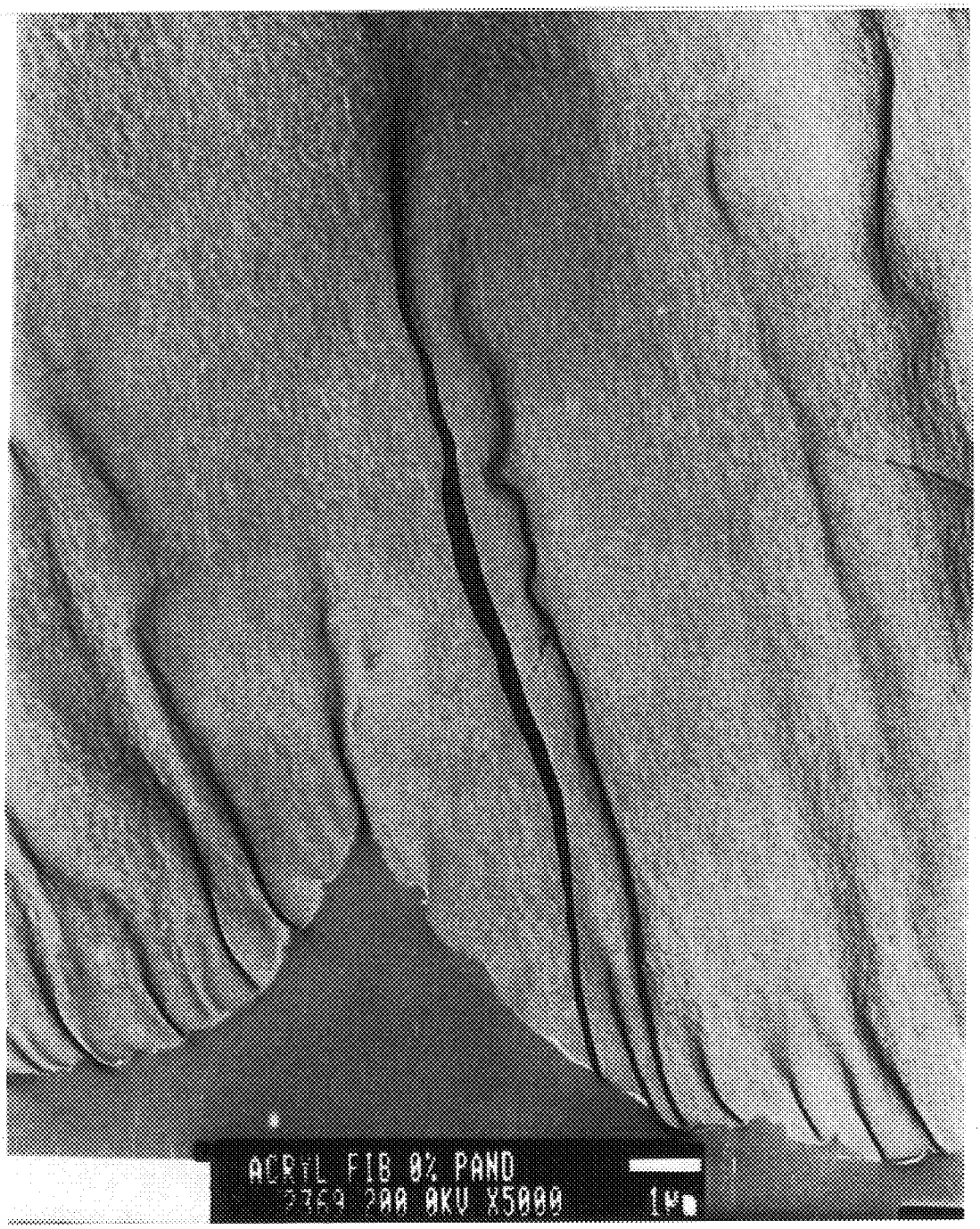
FIG. 1 shows cross-sectional views of a fiber of Acrilan® containing no polyaniline using transmission electron microscopy taken at magnifications of, (a) 5000×, (b) 6800×, and (c) 50,000×.

In accordance with the present invention, a method is provided for preparing fibers containing an ICP by first forming a spinning solution from an ICP salt, a matrix polymer, and a solvent in which both the ICP salt and the matrix polymer are soluble. This spinning solution is forced through a spinneret and is contacted with a nonsolvent for both the ICP salt and the matrix polymer. This contact between the spinning solution and the nonsolvent causes the liquid jets of spinning solution to form into fibers which contain the ICP salt as well as the matrix polymer. In one preferred embodiment the ICP salt used to prepare the fiber has a solubility in xylenes equal to or greater than about 25% by weight.

The terms intrinsically conductive polymer, or ICP, as used herein, are intended to include any polymer that, in at least one valence state, has an electrical conductivity greater than about $10^{-8}$ S/cm and preferably greater than about $10^{-6}$ S/cm. ICP's generally have polyconjugated $\pi$ electron systems and can be doped with an ionic dopant species to an electrically conductive state. A number of conjugated organic polymers that are suitable for this purpose are known in the art and include, for example, polyaniline, polyacetylene, poly-p-phenylene, poly-m-phenylene, polyphenylene sulfide, polypyrrole, polythiophene, polycarbazole and the like.

It is known that ICP's, and specifically polyaniline, may be made electrically conductive either by electrochemical or chemical polymerization of protonated mononers, or by protonation of the neutral polymer by exposure to protonic acids (often called dopants). Polyaniline that is electrically conductive in its doped, or salt, form typically has a conductivity of greater than about $10^{-8}$ S/cm. However, in its neutral, or base form, it is non-conductive and has a conductivity of less than about $10^{-8}$ S/cm.

In general, polyanilines suitable for use in this invention are homopolymers and copolymers derived from the polymerization of unsubstituted or substituted anilines of Formula I:

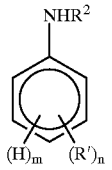

wherein:

n is an integer from 0 to about 2;

m is an integer from 2 to 4, with the proviso that the sum of n and m is equal to 5;

$R^1$ is aryl, alkyl or alkoxy having from 1 to about 30 carbon atoms, cyano, halo, acid functional groups, such as sulfonic acid, carboxylic acid, phosphonic acid, phosphoric acid, phosphinic acid, boric acid, sulfinic acid and the derivative thereof, such as salts, esters, and the like; amino, alkylamino, dialkylamino, arylamino, hydroxy, diarylamino, alkylarylamino, or alkyl, aryl or alkoxy substituted with one or more acid functional groups, such as sulfonic acid, carboxylic acid, phosphonic acid, phosphoric acid, phosphinic acid, boric acid, sulfinic acid and the derivative thereof, such as salts, esters, and the like; dialkylamino, arylamino, diarylamino, alkylarylamino, hydroxy, alkoxy, alkyl, and $R^2$ is the same or different at each occurrence and-is a $R^1$ substituent or hydrogen. Particularly preferred for use in this invention is the polyaniline produced from polymerization of unsubstituted aniline.

Polyanilines suitable for use in this invention are generally those which consist of repeat units of the Formulas II and/or III:

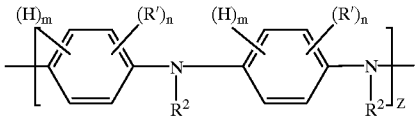

Formula III

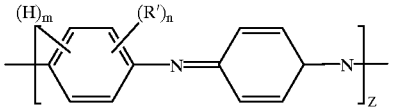

or a combination thereof having various ratios of the above repeat units in the polyaniline backbone. Illustrative of preferred polyanilines are those of Formulas IV and V:

wherein:

n is an integer from 0 to 1;

m is an integer from 3 to 4, with the proviso that the sum of n and m is equal to 4;

$R^1$ is alkyl of from 1 to about 20 carbon atoms, carboxylic acid, carboxylate, sulfonic acid, sulfonate, sulfinic acid, sulfinic acid salt, phosphinic acid, phosphinic acid salt, phosphonic acid or phosphonic acid salt;

$R^2$ is carboxylic acid, methyl, ethyl, carboxylate, sulfonic acid, sulfonate, sulfinic acid, phosphinic acid, phosphonic acid salt, sulfinate, phosphonic acid, phosphonic acid salt, or hydrogen;

x is an integer equal to or greater than 2; and y is an integer equal to or greater than 1, with the proviso that the ratio of x to y is greater than 1; and z is an integer equal to or greater than about 10.

In the more preferred embodiments of this invention, the polyaniline is derived from aniline or N-alkylaniline either unsubstituted or substituted with at least one sulfonate, sulfonic acid, alkyl or alkoxy. The most preferred polyaniline is polyaniline derived from unsubstituted aniline.

ICP's, and polyaniline in particular, can be prepared by any suitable method. For example, polyaniline may be synthesized by chemical polymerization of ICP-monomers from aqueous solutions or mixed aqueous and organic solutions, or by electrochemical polymerization in solutions or emulsions.

The ICP salts which may be used in this invention are those formed from any of the above-mentioned ICP's and from an organic acid. Preferred organic acids have a non-polar or slightly polar substituent group. The organic acid is used as a dopant to the ICP. When added to a polyaniline, the organic acid protonates the polyaniline and forms an electrically conductive salt of the polyaniline. The organic acid salt of polyaniline can be formed either during or after polymerization of the aniline. Organic acids which are suitable for use in the present invention, in general, have the formula:

$$M^+-[SO_3^--] \qquad \text{FORMULA VI}$$

wherein, M is a metal or non-metal cation;

R is substituted or unsubstituted alkyl, phenyl, naphthalene, anthracene or phenanthrene, which may have from zero to about four substituents and wherein permissible substituents are selected from the group consisting of alkyl, phenyl, haloalkyl, perhaloalkyl, and wherein the substituent group has from about 6 to about 30 carbon atoms. Preferred for use in the ICP salts in the present invention are organic Formula IV

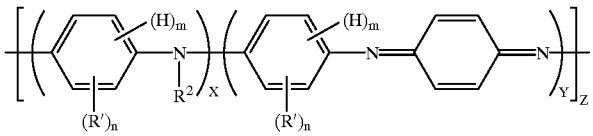

Formula V

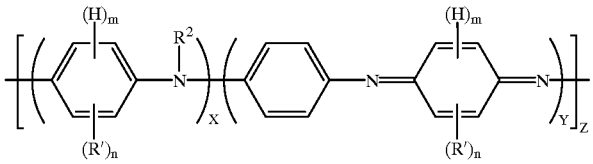

acids wherein M is hydrogen and R is octyl, nonyl, decyl, dodecyl, benzene, dodecylbenzene, anisidine, chlorobenzene, toluene or dinonylnaphthalene. The most preferred organic acid for use in ICP salts, and particularly for organic acid salts of polyaniline, is dinonylnaphthalene sulfonic acid.

ICP salts for use in the present invention may be formed by any suitable method and are preferably of the type having a solubility in organic solvents, such as, for example, xylenes, of preferably at least about 10%, more preferably at least about 15%, even more preferably at least about 20%, and most preferably at least 30% or greater on a weight per weight basis. Thus, for a solubility of 25% on a weight per weight basis, 25 grams of such ICP salt will dissolve in 75 grams of xylene at 60° F.

In an embodiment of the present invention where an organic acid salt of polyaniline is used, the xylene-soluble polyanilines prepared by the emulsion-polymerization method as described in U.S. Patent No. 5,567,356, which is hereby incorporated herein by reference, are most preferred. Briefly, the method for preparing such preferred xylene-soluble polyaniline salts involves combining water, an organic polymerization solvent in which water is soluble in an amount of at least about 6% wt/wt, an organic acid soluble in said organic solvent, aniline, and a radical initiator such as a chemical oxidant. A particularly preferred organic acid salt of polyaniline, which is made by this method is the polyaniline salt of dinonylnaphthalene sulfonic acid (the polyaniline salt of DNNSA). The polyaniline salt produced by this emulsion-polymerization method is readily processable as a result of its being highly soluble in a variety of organic solvents. For example, one such organic solvent is xylene which dissolves the DNNSA salt of polyaniline as prepared by emulsion polymerization at a concentration equal to or greater than about 25% by weight.

The second component of the spinning solution is a matrix polymer which confers upon the fibers prepared from the polymer blend the tensile properties suitable for use in a fabric. In general, the matrix polymer is not electrically conductive, typically having a conductivity of below about $10^{-5}$ S/cm. The matrix polymer is soluble in the spinning solvent in the presence of the ICP salt. The matrix polymer and the ICP salt are preferably co-miscible, i.e., they form a single phase when both are dissolved in a common solvent.

The matrix polymer can be any of a number of polymers known to be suitable for producing fibers for use in textile materials. Typically, fibers produced from such matrix have tensile properties which make them suitable for use in textiles. One such characteristic property for textile fibers is tenacity. As used herein, tenacity is the breaking load of a fiber in grams per denier (g/den), a denier being the mass of 9,000 meters of a single fiber. Polymers capable of being incorporated into fibers suitable for use in textile materials typically result in fibers having tenacity values of from about 0.5 to about 5.0 g/den. Matrix polymers preferred for use in the present invention result in fibers having tenacity values equal to or greater than 1.0 g/den.

A wide variety of natural and synthetic polymers yield fiber having such tenacity values and are suitable for use in textile fibers and are also suitable as matrix polymers for use in the present invention. Such suitable matrix polymer substances include, for example, cellulose (including cellulose acetate, cellulose triacetate and viscous cellulose); polyacrylonitrile; polyamides; polyesters; polyolefins; polyurethanes; polyvinyl chloride; polyvinylidene chloride; polyvinyl bromide; and co-polymers and blends comprising predominately such polymers. A preferred matrix polymer is polyacrylonitrile and blends thereof. An especially preferred polyacrylonitrile is Acrilan® CP-16, which is a co-polymer of predominantly acrylonitrile and vinyl acetate monomers.

The spinning solvent of this invention is an organic solvent or an aqueous solution of a salt or acid in which the ICP salt and the matrix polymer are substantially soluble. By substantially soluble, it is meant that each of the ICP salt and the matrix polymer is soluble in the spinning solvent at a concentration of at least about 25 mg/ml, more preferably at a concentration of at least about 100 mg/ml and most preferably at a concentration of at least about 200 mg/ml. While not intending to be bound by any theoretical mechanism of action, it is believed that the matrix solvent is able to disperse the polymer chain by forming a dipolar interaction with the polymer chains. *Handbook of Fiber Science and Technology* edited by M. Lewin and E. M. Price, 171–370, Marcel Dekker, Inc., 1985. When the spinning solvent is an organic solvent, the organic solvent preferentially has a strong dipole moment and a relatively low molecular weight.

The spinning solvent also has the capability of dissolving other organic substances which may be present in compositions of the preferred ICP salt. For example, the organic acid salt of polyaniline produced by emulsion polymerization can be used in a product form which contains the organic acid salt of polyaniline along with polymerization solvents such as 2-butoxyethanol. In addition, such polyaniline salt may contain a carrier solvent such as xylene. Thus, upon addition of the preferred polyaniline salt, the spinning solvent may include polymerization and/or carrier solvents, such as, for example, xylene, toluene, 4-methyl-2-pentanone, trichloroethylene, butyl acetate, 2-butoxyethanol, n-decyl alcohol, chloroform, hexanes, cyclohexane, 1-pentanol, 1-butanol, 1-octanol, 1,4 dioxane, m-cresol, and, in particular, xylene and 2-butoxyethanol, which may be added to the spinning solution along with the polyaniline salt, and in particular with polyaniline salt produced by emulsion polymerization.

Particularly useful spinning solvents include, but are not limited to, dimethylacetamide, dimethylformamide, dimethyl sulfoxide, ethylene carbonate, aqueous sodium thiocyanate, aqueous zinc chloride, aqueous sulfuric acid and aqueous nitric acid. Preferred as a spinning solvent is dimethylacetamide. The spinning solvents mentioned above are representative exemplifications only and the skilled artisan can readily select an organic solvent suitable for use as a spinning solvent.

The spinning solution is prepared, in general, by mixing together the ICP salt, the matrix polymer and the spinning solvent. Whereas, the preferred spinning solution of the present invention is a mixture of an organic acid salt of polyaniline as the ICP salt, polyacrylonitrile or a polyacrylonitrile copolymer as the matrix polymer and dimethylacetamide as the spinning solvent, other matrix polymers and spinning solvents could be used as well as other polyaniline salts or other ICP salts. For example, other possible matrix polymer/spinning solvent combinations are; regenerated cellulose/viscose process-sodium hydroxide; cellulose acetate/acetone; aramids/sulfuric acid; polyurethane/dimethylacetamide; poly(vinyl chloride)/acetone-benzene; poly(vinyl alcohol)/water; polybenzimidazole/dimethylacetamide; and nylons/formic acid. For any combination of ICP salt, matrix polymer and spinning solvent, however, the polymers used in the spinning solution can be intermixed to form a homogeneous mixture. The term, homogeneous mixture, is intended to mean a solution, a dispersion or an emulsion formed by the ICP salt and the matrix polymer when mixed with the spinning solvent and other organic materials such as the polymerization solvent and the carrier solvent mentioned above. Thus, the polymers are blended together in the spinning solution prior to formation of the fibers.

While the spinning solution may be mixed under any suitable conditions, it is preferred to add the polymers to the spinning solvent beginning at a relatively cold temperature of from 0° C. to about 15° C., and then to gradually increase the temperature up to, or above, the desired spinning temperature of from about ambient temperature up to about 100° C. While this technique is not required, it can facilitate the dissolution of the polymers in the spinning solvent.

Amounts, based on the weight of a component relative to the weight of the spinning solution, for the various components of the spinning solution of this invention are preferably from about 0.5% to about 40% polyaniline salt, from about 1% to about 40% matrix polymer and from about 20% to about 98.5% spinning solvent; more preferably from about 0.5% to about 20% polyaniline salt, from about 5% to about 40% matrix polymer and from about 40% to about 96.5% spinning solvent; and still more preferred from about 1% to about 20% polyaniline salt, from about 10% to about 40% matrix polymer and from about 40% to about 89% spinning solvent. The balance of the spinning solution can be composed of other organic materials such as the polymerization solvent and the carrier solvent.

In the conventional wet spinning process, fibers are formed by injecting small-diameter streams of the spinning solution, containing the polymeric blend, into a coagulation bath in which a nonsolvent liquid causes the polymers to precipitate and to form fibers.

The liquid in the coagulation bath is a nonsolvent for both the matrix polymer and the ICP salt. The ICP salt and the matrix polymer are substantially insoluble in the nonsolvent in one embodiment of the present invention. As used herein, the term, "substantially insoluble" means that a material dissolves in a liquid in an amount less than about 0.1% wt/wt. Suitable nonsolvents include polar solvents such as ethyl alcohol, methyl alcohol and water or mixtures thereof. A preferred nonsolvent is water. The nonsolvents mentioned are representative exemplifications only and other nonsolvents meeting the above criteria may be substituted for them as will be readily recognized by one skilled in the art.

The nonsolvent can also comprise a mixture of a nonsolvent in which the ICP salt and matrix polymer are substantially insoluble and a solvent, such as the spinning solvent described above, in which the ICP salt and the matrix polymer are substantially soluble. Such a mixture is thought to effect a slower, more controlled extraction of the spinning solvent from the coagulating ICP-containing fiber. In such a case where a mixture of two or more liquids is used as the nonsolvent, such liquids should be mutually soluble and form a single phase solution. An example of such a nonsolvent mixture is a combination of water and dimethylacetamide. When such a mixture is used as the nonsolvent in the method of the present invention the nonsolvent can comprise, on a weight basis, from about 40% to 100% water and from 0% to about 60% dimethylacetamide. Fibers within the scope of the present invention can be made that contain from about 1% to about 67% (wt/wt) of the ICP salt and from about 33% to about 99% of the matrix polymer.

Wet spinning, or solution spinning of fibers is well known and a general description of such technology may be found in, among other references, Capone, G. J., *Wet-Spinning Technology*, Ch. 4 in *Acrylic Fiber Technology and Applications*, James C. Masson, Ed., Marcel Dekker, Inc., 1995, which is hereby incorporated herein by reference. In general, once the spinning solution is made up, it is often filtered prior to spinning to remove small solid particles which might clog the holes of the spinneret. After filtration, the spinning solution, also called spinning dope, is forced through the holes of a spinneret. Usually a pump which generates significant pressure, such as a gear pump, is used to force the spinning solution through the spinneret. A spinneret, as used herein, means a die having one or more holes through which the spinning solution is extruded. Typically, a spinneret has multiple holes.

The spinneret must have at least one hole, but may typically have from about 50 to about 200,000 holes with hole diameter from about 0.05 to over 1.0 millimeters. The holes are often arranged to improve the diffusion of the spinning solution across the spinneret face. Patterns include concentric annuli, rectilinial rows of holes, scatter arrangements, or clusters of holes with relatively wide spaces in between. Moreover, several spinnerets can be located in a single coagulation bath.

The downstream side of the spinneret may be located either above or below the liquid surface of a coagulation bath, so that the spinning solution exiting the spinneret contacts the coagulation bath liquid immediately or soon after exiting. Formation of the ICP-containing fibers occurs rapidly as the jets of the mixture enter the coagulation bath and contact the nonsolvent. The nonsolvent extracts or withdraws the spinning solvent from the jets of spinning solution exiting each spinneret hole causing the polymers to supersaturate the spinning solution and to begin to precipitate as solids in the shape of fibers. As spinning solvent diffuses from the forming fibers, the polymers continue to precipitate and to form a fiber which, it is thought, is initially composed of a structure of interlocking fibrils separated by a significant amount of liquid. While still in the coagulation bath, the fiber achieves sufficient cohesion and strength to remain unbroken upon removal from the bath.

The fibers are commonly either continuously or periodically removed from the coagulation bath by a take-up or pick-up roll, or Godet, followed by a series of further processing operations, including immersion in a series of coagulation baths, washing, wet stretching or orientational drawing, drying, optionally hot stretching and annealing, all of which are used to produce desirable physical properties required of fibers for use in textile materials.

In a wet stretching operation, for example, the fibers from each spinneret, upon exiting the coagulation bath are typically combined to form a single large strand or tow. The fibers are then washed, commonly with water, to remove the desired amount of spinning solvent in one or more baths or showers and then stretched in one or more draw baths containing water that is at or close to boiling. It should be noted that stretching can also be carried out in conjunction with the washing. It is thought that the stretching causes polymer chains of the polymer components of the fiber to become oriented along the axis of each ICP-containing fiber, resulting in high modulus and tenacity.

In a typical drying operation, the ICP-containing fibers are passed over a series of heated rolls and held under sufficient tension to provide good heat transfer to the fibers. It is during the drying process that the residual nonsolvent is removed from the ICP-containing fiber substantially to the final level desired.

To further enhance the physical properties of the ICP-containing fibers, they can be given a relaxation or annealing treatment that will make them more extensible. Usually this annealing involves some type of heat treatment in the presence of moisture that causes the fiber to shrink. The ensuing molecular disorientation lowers the modulus and tenacity, but this is more than offset by an increase in the breaking elongation and resistance to fibrillation. In addition to orientational drawing, drying and annealing, the ICP-containing fibers may also be subjected to other operations including finish application and crimping for a tow, or cutting for a staple fiber product.

Initial fiber formation in the coagulation bath produces porous fibers. The pores of such fibers act as dye sites and enhance the coagulating fibers dye-receptivity. Thus, if desired, colored fibers may be produced by the incorporation of either insoluble pigments or soluble cationic dyestuffs that react with dye sites in the fibers during coagulation. Although enhancing the fibers' dye-receptivity, these voids are not desirable as they can affect the physical properties of the fibers. Even after drawing the fiber, however, the void volume fraction can be over 50%. Therefore, the porous fibers are usually subjected to drying processes which cause the voids to collapse, thereby substantially eliminating the fibers' porosity.

While the above described process is often referred to as wet-spinning, it will be apparent to one skilled in the art that the method of producing ICP-containing fibers described herein may also be readily adapted to other processes suitable for the manufacture of fibers including, for example, dispersion spinning, dry-spinning, dry-jet wet spinning or air-gap spinning, emulsion spinning, gel spinning, grid spinning and reaction spinning. Likewise, it will be apparent to one skilled in the art that the ICP-containing fibers of the present invention may be produced by any of the above-mentioned methods, or by methods such as melt-spinning, reaction spinning, plasticized-melt spinning and tack spinning.

Figure 3A:
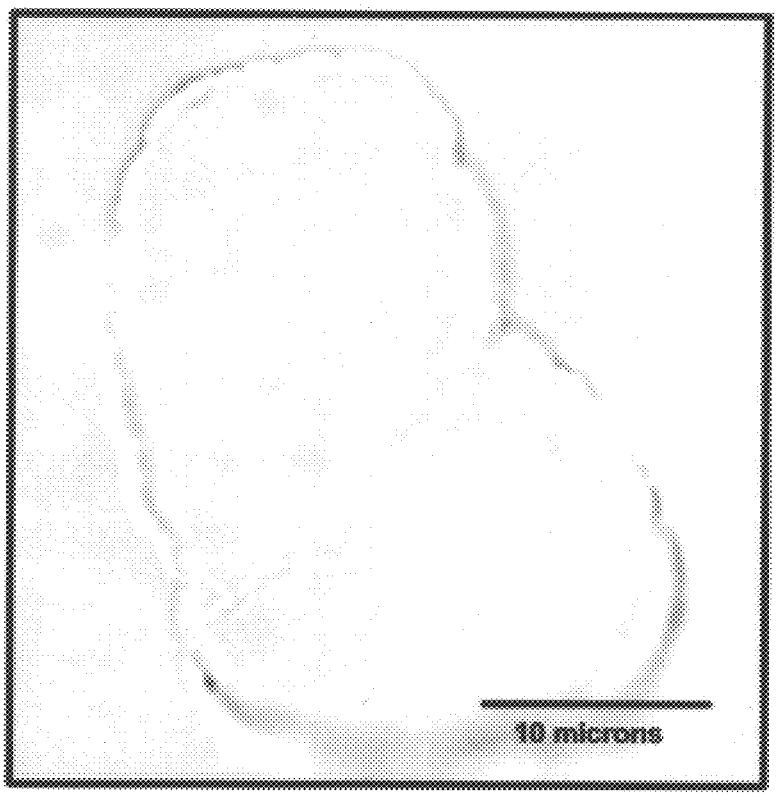
FIG. 3 shows computer generated color image cross-sectional views of a fiber containing pure Acrilan® with 0% polyaniline, FIG. 3(*a*), and a fiber containing a blend of about 20% wt/wt polyaniline salt and about 80% wt/wt Acrilan®, FIG. 3(*b*)
Figure 3B:
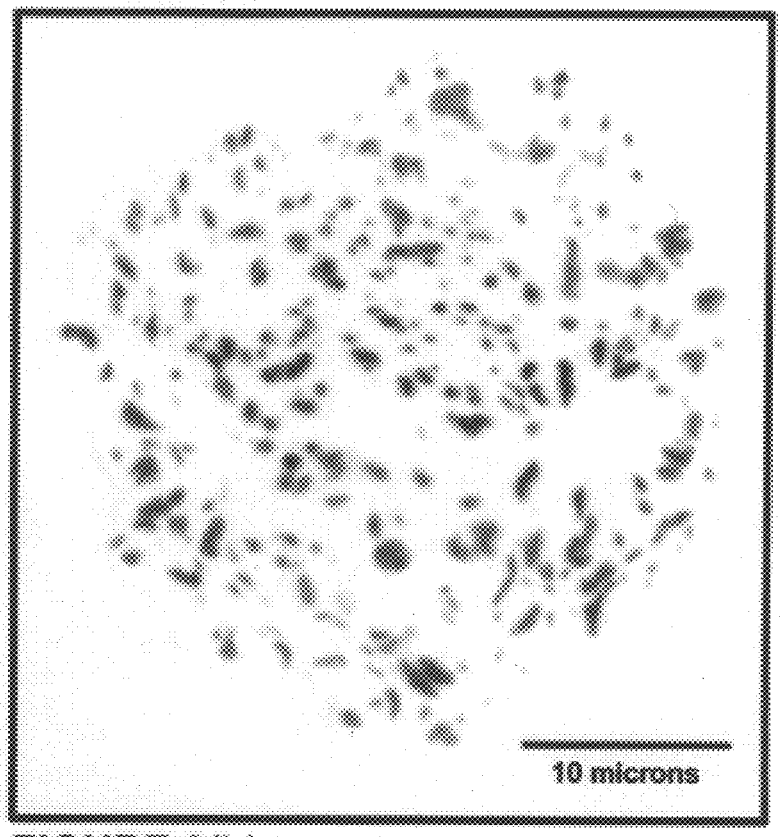

The ICP-containing fibers of the present invention comprise a novel polyblend of the organic acid salt of an ICP, such as polyaniline, and the matrix polymer. The ICP salt is substantially evenly distributed along with the matrix polymer in the spinning solution prior to fiber formation. In the final fibers, the polyaniline salt is dispersed throughout the matrix polymer. By dispersed throughout the matrix polymer it is meant that the polymer blend is homogeneous, or alternately, that some or all of the polyaniline salt can form discrete, non-connected particles separate from and substantially evenly distributed in the matrix polymer, or the remaining mixture of polyaniline salt and matrix polymer. Such particle formation may occur during fiber formation and it is believed to be a function of the particular ICP salt and matrix polymer used and of the level of ICP salt in the blend. Some combinations, such as the DNNSA salt of polyaniline and polyacrylonitrile form such discrete areas of ICP salt at a polyaniline salt level of about 20% wt/wt in the fiber. The cross-section of a polyacrylonitrile fiber containing about 20% wt/wt of the polyaniline salt of DNNSA is shown in FIG. 3(*b*) and illustrates such discrete, non-connected particles distributed throughout the fiber.

On the other hand, it is believed that other combinations of ICP salt and matrix polymer will produce homogeneous fiber compositions. In particular, the organic acid can be selected for its compatibility or solubility in the matrix polymer. The ICP salt formed from such an organic acid is believed to be capable of forming homogeneous compositions of polyaniline salt with the matrix polymer in the final fiber.

The ICP-containing fibers of the present invention as exemplified by the blend of the DNNSA salt of polyaniline and polyacrylonitrile have the mechanical properties suitable for use in textile and structural fibers. The fibers formed from such blends have a fiber denier ranging from about 0.5 to about 20. Furthermore, the ICP-containing fibers of the present invention have a tenacity of at least 0.5 to about 5.0 g/den and preferably of at least 1.0 g/den, up to about 5.0 g/den or greater. The polyblend comprises from about 1% to about 67% ICP salt and from about 33% to about 99% matrix polymer and/or other desirable fiber components on a weight basis.

In one embodiment of the present invention, the conductivity of the ICP-containing fibers is less than about $10^{-8}$ S/cm, and preferably less than about $10^{-5}$ S/cm. The electrical conductivity of the ICP salt which is incorporated into the fibers may be significantly higher than this level. The ICP salt preferably has a conductivity of greater than about $10^{-8}$ S/cm, more preferably greater than about $10^{-5}$ S/cm, even more preferably greater than about $10^{-3}$ S/cm and most preferably greater than about $10^{-1}$ S/cm. By reference to the conductivity of the ICP salt component of a fiber it is meant that a fiber substantially containing the ICP salt alone (i.e., greater than about 95% ICP salt) would have the indicated conductivity. The ICP salt is, however, incorporated into the fibers is such a way that the conductivity of the fibers is not increased over the conductivity of the matrix polymer. It is believed that the conductivity of the fibers is at the levels indicated above as a result of the ICP salt being present in discrete particles which are not connected and thereby do not provide an electron path along the length of the fibers.

Industrial Application

The ICP-containing fibers of the present invention may be used in any manner in which conventional textile fibers are used. In addition, however, the present fibers are particularly useful in those applications which require the electrically conductive property, or the energy absorbing property of an ICP without the need of an electrically conductive medium or matrix. For example, the ICP salt containing fibers of the present invention may be useful for forming yarns or textiles which provide acoustic or vibrational energy absorption as shown in U.S. Pat. No. 5,526,324; or which absorb electromagnetic radiation, such as light waves, ultraviolet waves, microwaves, radar, or other electromagnetic waves as described, for example, in U.S. Pat. No. 5,294,694, in U.S. Pat. No. 5,381,149, in PCT publication WO90/03102 and by Olmedo et al., in *Synth. Metals*, 69:205–208, 1995. By using the fibers of the present invention, fabrics for these uses could be easily woven, tailored and applied for shielding applications, or in stealth technology. The fibers or yarn of the present invention could also provide a convenient way to apply ICP's in applications where the anti-corrosive property of polyaniline is useful.

Another potentially useful property of polyaniline is that doped and undoped polyanilines are of different color. Polyaniline in its protonated, or salt form, is green, while its non-protonated, base form, is blue. Thus, the property of reversibly changing color from green to blue on the basis of pH could be used to provide a calorimetric sensor for acids or bases with the polyaniline conveniently immobilized in a fiber.

Furthermore, the ICP-containing fibers of one embodiment of the present invention may find uses in microwave susceptible fibers, tow and/or fabrics of any sort, and any other use where the unique properties of physical durability, presence of ICP in a conductive form but causing no increase in fiber conductivity, are useful.

The following examples describe preferred embodiments of the invention. Other embodiments and equivalents within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims, which follow the examples. In the examples, all percentages are given on a weight basis unless otherwise indicated.

EXAMPLES 1–6

These examples illustrate the spinning of fibers containing the dinonylnaphthalene sulfonic acid salt of polyaniline and Acrilan® CP-16 in a laboratory apparatus using an extrusion pump.

The DNNSA salt of polyaniline (PANI-salt) was prepared according to the method disclosed in U.S. Pat. No. 5,567,356, which is incorporated by reference. In brief, such polyaniline salt was prepared by polymerization overnight from a starting mixture of water, 2-butoxyethanol, dinonylnapthalene sulfonic acid and aniline in an acid-to-aniline mole ratio of about 1.6:1. The resultant green phase containing polyaniline salt in 2-butoxyethanol was dissolved in xylene as a carrier solvent. The composition of the DNNSA salt of polyaniline product was about 50 wt. % polyaniline salt and 50 wt. % of a mixture of butyl-cellosolve (2-butoxyethanol) and xylene. However, the compositions could vary from about 48% to about 56% by weight of polyaniline and the total solids were measured for each sample of polyaniline DNNSA salt used.

Spinning solutions were prepared by mixing varying amounts of PANI-salt, the second polymer Acrilan® CP-16 (CP-16), (Monsanto, St. Louis, Mo.), and dimethylacetamide (DMAC), (Fisher Scientific, St. Louis, Mo.). The PANI-salt composition of the solutions was from about 1 to about 10%; the CP-16 from about 9 to about 20%; and the DMAC from about 78 to about 89% as shown in Table 1.

TABLE 1

| | Mixture | | |
|---|---|---|---|
| Example No. | PANI-salt (%) | CP-16 (%) | DMAC (%) |
| 1 | 1 | 10 | 89 |
| 2 | 1 | 20 | 79 |
| 3 | 2 | 20 | 78 |
| 4 | 2 | 20 | 78 |
| 5 | 2 | 20 | 78 |
| 6 | 10 | 9 | 81 |

A total of between about 15 and 40 grams of spinning solution was prepared for each example. The mixtures were warmed and stirred as needed to dissolve all solids. A given mixture was then drawn into a Becton-Dickenson disposable syringe equipped with a needle of from 18 to 22 gauge. Using a Sage Model 341B pump, the mixture was extruded from the syringe in the form of a fiber. In general, the tip of the needle was placed under the bath surface and the extruded fiber was carefully gathered from the bath by hand. Fibers were extruded into a coagulation bath containing a 50/50 mixture of deionized water and DMAC (coagulation bath nonsolvents). The coagulation bath was maintained at a temperature of 38° C.

The fibers of Examples 1–6, prepared by this method were medium to dark green, indicating the presence of the conductive emeraldine salt form of polyaniline rather than the emeraldine base which is blue in color. The electrical resistance of the fibers containing PANI-salt was, however, greater than $10^{11}$ ohms, the maximum level of sensitivity of a Beckman MegOhm meter, 15 indicating that the fibers were not electrically conductive.

EXAMPLES 7–17

These examples illustrate the spinning of fibers containing the dinonylnaphthalene sulfonic acid salt of polyaniline (PANI-salt) and Acrilan® CP-16 using pilot scale commercial-type spinning apparatus.

For Examples 11–17, PANI-salt, prepared as in Examples 1 through 6, was premixed with DMAC, which had been chilled to about 12° C., in a batching container under heavy agitation. CP-16 was then added to each mixture under agitation. Each batch mixture was heated while continuing the agitation in a water bath for about 50 minutes until it attained a temperature of 80° C. The temperature of each batch mixture was maintained at 80° C. for about one hour. Undissolved particles were filtered from each batch mixture prior to spinning. For comparative purposes, a control sample was prepared from CP-16 and DMAC with no PANI-salt. The control sample was used in Examples 7–10. The fibers produced in Examples 7–10, therefore, are illustrative of regular acrylic fibers produced by a commercial wet-spinning technique.

The mixture or spinning solution of Examples 11–14 contained 2.52 g PANI-salt (the PANI-salt was supplied as a paste containing 48.3% by wt. polyaniline salt of DNNSA with the balance 2-butoxyethanol and xylene), 117.0 g Acrilan® CP-16 and 468.5 g DMAC. The solids composition was 1% by wt. polyaniline salt and 99% by wt. Acrilan® CP-16. The spinning solution of Examples 15–17 contained 26.92 g PANI-salt (from the same source as in Examples 11–14), 117.1 g CP-16 and 501.7 g DMAC. The solids composition was 10% by wt. polyaniline salt and 90% by wt. Acrilan® CP-16.

Using a Zenith Pump #1 operating at about 6.35 revolutions per minute, each spinning solution was extruded at a rate of about 3.71 cc/min through a spinneret having 50 holes each of 5 mils diameter. Upon extrusion from the spinneret, the spinning solution were brought into contact with a coagulation bath comprised of a 50/50 mixture of water and DMAC maintained at 55° C. The coagulated fibers were removed from the coagulation bath and taken up to form wraps around a first roller which rotated at a velocity of about 14 ft/min. Such rollers are referred to in the art and hereinafter as godets. The fibers were wrapped around the first, or take-up godet 18 times. The jet stretch ratio was 0.68. The jet stretch ratio is the ratio of two linear velocities, A/B, where A is the measured speed of the threadline in the coagulation bath at least several inches away from the spinneret surface (which is typically from 3–16 m/min), and B is the theoretical linear velocity of the jet of spinning solution immediately prior to exiting the spinneret, and is calculated on the basis of the nominal velocity through one of the spinneret holes (the volumetric flow rate of the spinning solution to the spinneret divided by the total cross-section area of the spinneret holes or capillaries). Increasing the jet stretch will tend to increase the degree of molecular alignment of the polymer molecules in the fiber.

Fibers taken up by the first godet were washed with water at 55° C. Fibers produced from the control sample were not washed. All fibers were, however, next pulled through a series of five cascaded drawing baths, each of which contained water at 98° C. Water was added at a rate of about 30 cc/min to the first of this series of cascaded draw baths.

The fibers were pulled through the draw baths by a drier godet which rotated at velocities ranging from about 56 to about 98 ft/min. The fibers were wrapped around the drier godet 16 times. The ratio of the velocity of the drier godet to the velocity of the first godet provided the wet stretch ratio or orientational draw ratio. Fibers spun from the spinning solutions in Examples 7–17 had wet stretch ratios ranging from 4 to 7. Fiber breakage occurred at wet stretch ratios of 9.8, 8.0 and 6.0 for Examples 7–10, 11–14 and 15–17 respectively.

A dual-function finish emulsion composed of a quaternary salt anti-static agent and a soya oil-based lubricant was applied to the fibers after washing out residual solvent to reduce the static repulsion between individual fiber filaments thus making the tow bundle easier to handle.

After passing over the drier godet, the fibers were annealed at up to 35 psi saturated steam pressure under the following conditions: fibers are placed into an autoclave and subjected to a cycle of increasing and decreasing pressure of saturated steam. The fibers shrink 20% to 30% under this treatment and become more ductile and less stiff, and the tendency for the individual filaments to fibrillate under end use wear conditions is much reduced.

The general conditions used for spinning the fibers of Examples 7–17 are presented in Table 2. Tables 3, 4 and 5, give stretching and annealing conditions and annealing shrinkage for fibers containing 0%, 1% and 10% by wt. polyaniline salt, respectively. Table 6 shows the physical properties of final fiber samples from Examples 7–17 under standard conditions and Table 7 shows the physical properties for the fiber samples from the same Examples in a "knot test".

TABLE 2

| Example No. | 7–10 | 11–14 | 15–17 |
|---|---|---|---|
| Solids in Spinning Solution: | | | |
| PANI-salt (%) | 0% | 1% | 10% |
| CP-16 (%) | 100% | 99% | 90% |
| Viscosity (cps) at 70° C. | 7500 | 5520 | 4650 |
| Mixture Rate (cc/min) | 3.71 | 3.71 | 3.71 |
| Zenith Pump #1 (RPM) | 6.35 | 6.35 | 6.35 |
| Mixture Temp. (° C.) | 30 | 30 | 30 |
| Jet (holes/mils) | 50/5 | 50/5 | 50/5 |
| Jet Stretch | 0.68 | 0.68 | 0.68 |
| Godet #1 (fpm) | 14.0 | 14.0 | 14.0 |
| Wraps | 18 | 18 | 18 |
| Wash $H_2O$ Temp. (° C.) | N/A | 55 | 55 |
| #1 Wash (° C.) | 98 | 98 | 98 |
| $H_2O$ Add (cc/min) | 30 | 30 | 30 |
| #2 Wash (° C.) | 98 | 98 | 98 |
| $H_2O$ Add (cc/min) | cascade | cascade | cascade |
| #3 Wash (° C.) | 98 | 98 | 98 |
| $H_2O$ Add (cc/min) | cascade | cascade | cascade |
| #4 Wash (° C.) | 98 | 98 | 98 |
| $H_2O$ Add (cc/min) | cascade | cascade | cascade |
| #5 Wash (° C.) | 98 | 98 | 98 |
| $H_2O$ Add (cc/min) | cascade | cascade | cascade |
| Wet Stretch | See Table 3 | See Table 4 | See Table 5 |
| Type Finish | CF30 | CF30 | CF30 |
| Temp (° C.) | 55 | 55 | 55 |
| Solids (%) | 0.30 | 0.30 | 0.30 |
| Drier Godet (fpm) | See Table 3 | See Table 4 | See Table 5 |
| Wraps | 16 | 16 | 16 |
| psi | 35 | 35 | 35 |

TABLE 2-continued

| Example No. | 7–10 | 11–14 | 15–17 |
|---|---|---|---|
| Unannealed (dpf) | See Table 3 | See Table 4 | See Table 5 |
| Annealing Shrinkage[1] (%) | See Table 3 | See Table 4 | See Table 5 |

[1]Annealed at 10 × 35 psi.

TABLE 3

| Wet Stretch* | Drier Godet (fpm) | Unannealed (dpf) | Annealing Shrinkage (%) |
|---|---|---|---|
| 4.0 | 56.0 | 8.23 | 24.1 |
| 5.0 | 70.0 | 5.87 | 28.3 |
| 6.0 | 84.0 | 5.34 | 28.4 |
| 7.0 | 98.0 | 4.44 | no data |

*Fiber breakage occurred at a wet stretch of 9.8.

TABLE 4

| Wet Stretch* | Drier Godet (fpm) | Unannealed (dpf) | Annealing Shrinkage (%) |
|---|---|---|---|
| 4.0 | 56.0 | 6.5 | 24.3 |
| 5.0 | 70.0 | 6.2 | 25.1 |
| 6.0 | 84.0 | 4.9 | 28.5 |
| 7.0 | 98.0 | 4.2 | 29.7 |

*Fiber breakage occurred at a wet stretch of 8.0. Fiber samples were light green in color.

TABLE 5

| Wet Stretch* | Drier Godet (fpm) | Unannealed (dpf) | Annealing Shrinkage (%) |
|---|---|---|---|
| 4.0 | 56.0 | 6.97 | 24.0 |
| 5.0 | 70.0 | 5.86 | 27.7 |
| 6.0 | 84.0 | 3.57 | 28.2 |

*Fiber breakage occurred at wet stretch of 6.0. Fiber samples collected were dark green in color.

TABLE 6

| Example No. | % PANI-salt in Fiber | Electrical Conductivity (S/cm) | Viscosity (cP) | Wet Stretch Ratio | Fiber Denier | Elongation (%) | Tenacity (g/den) | Modulus (g/den) | Toughness (g/den) |
|---|---|---|---|---|---|---|---|---|---|
| 7 | 0 | $1.21 \times 10^{-6}$ | 7,500 | 4.0 | 9.630 | 34.69 | 1.931 | 49.83 | 0.4908 |
| 8 | 0 | $1.14 \times 10^{-6}$ | 7,500 | 5.0 | 8.760 | 36.77 | 2.101 | 46.91 | 0.5391 |
| 9 | 0 | $1.47 \times 10^{-6}$ | 7,500 | 6.0 | 7.667 | 34.14 | 2.292 | 46.41 | 0.5229 |
| 10 | 0 | $1.42 \times 10^{-6}$ | 7,500 | 7.0 | 6.435 | 34.85 | 2.627 | 50.61 | 0.5957 |
| 11 | 1 | $0.75 \times 10^{-6}$ | 5,520 | 4.0 | 10.89 | 33.61 | 1.651 | 38.02 | 0.3985 |
| 12 | 1 | $0.72 \times 10^{-6}$ | 5,520 | 5.0 | 8.593 | 34.32 | 2.037 | 44.95 | 0.4810 |
| 13 | 1 | $1.19 \times 10^{-6}$ | 5,520 | 6.0 | 6.351 | 31.36 | 2.360 | 47.16 | 0.4943 |
| 14 | 1 | $1.12 \times 10^{-6}$ | 5,520 | 7.0 | 6.817 | 28.44 | 2.359 | 48.86 | 0.4354 |
| 15 | 10 | $0.32 \times 10^{-7}$ | 4,650 | 4.0 | 9.570 | 26.53 | 1.452 | 43.78 | 0.2991 |
| 16 | 10 | $0.92 \times 10^{-7}$ | 4,650 | 5.0 | 9.240 | 31.09 | 1.513 | 39.62 | 0.3516 |
| 17 | 10 | $1.9 \times 10^{-7}$ | 4,650 | 6.0 | 6.799 | 28.17 | 1.844 | 44.43 | 0.3647 |

TABLE 7

| Example No. | % PANI-salt in Fiber | Wet Stretch Ratio | Fiber Denier | Elongation (%) | Tenacity (g/den) | Modulus (g/den) | Toughness (g/den) |
|---|---|---|---|---|---|---|---|
| 7 | 0 | 4.0 | 9.740 | 20.89 | 1.469 | 27.53 | 0.2356 |
| 8 | 0 | 5.0 | 8.480 | 24.48 | 1.647 | 27.88 | 0.2930 |
| 9 | 0 | 6.0 | 7.642 | 26.16 | 1.854 | 32.76 | 0.3457 |
| 10 | 0 | 7.0 | 6.349 | 25.51 | 2.096 | 38.74 | 0.3734 |
| 11 | 1 | 4.0 | 10.95 | 20.63 | 1.286 | 22.38 | 0.2000 |
| 12 | 1 | 5.0 | 8.740 | 24.92 | 1.649 | 28.17 | 0.2911 |
| 13 | 1 | 6.0 | 6.565 | 23.30 | 1.886 | 33.00 | 0.2948 |
| 14 | 1 | 7.0 | 5.943 | 17.27 | 1.622 | 31.08 | 0.2037 |
| 15 | 10 | 4.0 | 10.42 | 8.700 | 0.6072 | 12.97 | 0.0235 |
| 16 | 10 | 5.0 | 10.02 | 13.79 | 0.859 | 16.11 | 0.1001 |
| 17 | 10 | 6.0 | 7.156 | 27.19 | 1.627 | 20.35 | 0.3126 |

Tensile strength is tested by mounting the fiber in a testing machine by attaching the fiber to a pair of grips that will move apart at a constant rate and stretch the fiber. A plot is generated of force in grams versus distance the grips have separated. The force is converted into grams per denier by dividing by the denier of the fiber. The distance between grips is converted to percent elongation by dividing the stretched fiber length minus the original fiber length by the original fiber length and multiplying by 100. The fiber is stretched until it breaks and the breaking elongation is calculated from the above-described relationship. The tenacity is the force on the fiber at the breaking point expressed in grams per denier. The modulus is the slope of the curve of force vs. elongation and can be measured at various points along the curve, but is usually taken at an early value of stretch and is called the initial modulus. The initial modulus can be thought of as the resistance to a small deformation, i.e., the stiffness.

Toughness is the area under the force vs. elongation curve and represents the total work required to deform the fiber to a specified elongation. If that elongation is the elongation at breaking, then the area under the curve up to the breaking point is the breaking toughness. Toughness reported alone usually means the breaking toughness.

The "knot test" provides an indication of properties in the lateral or transverse, direction of the fiber, as opposed to along the length of the fiber. The knot test is administered by tying a knot in the fiber or tow bundle and then performing the same series of tensile tests as described above. As the load on the fiber increases, the fiber within the knot will begin to bend and squeeze adjoining fiber and generally subject it to a complicated array of stresses. This leads to a breaking elongation that is lower than the corresponding value achieved without the knot, and the ratio of the knot tensile to normal tensile properties can be taken as a qualitative indication of the transverse or lateral fiber properties.

In the normal (without knot) tests of fiber properties, Examples 7–10 of Table 6, in which the only process change is the increase in wet stretch ratio from 4.0 to 7.0, show that there is a concomitant decrease in denier per filament, as one would expect, by increasing the stretch. The tenacity and toughness go up slightly with stretch ratio. The addition of 1% by wt. PANI-salt, Examples 11–14, reduces the viscosity of the spinning solution from 7500 to 5520 centipoise. Again, there is a general trend of a reduction in denier with increasing wet stretch. The tensile properties are not markedly affected by the addition of the PANI-salt, although there is some reduction in toughness. The addition of 10% by wt. PANI-salt into the fiber, Examples 15–17, does reduce the overall level of tensile properties, but generally by less than 50%, so significant fiber properties remain.

In the knot test, Table 7, for the control (Examples 7–10; no PANI-salt) all of the properties are reduced substantially over those reported in Table 6, without the knot. Addition of 1% PANI-salt, Examples 11–14, does not markedly affect the properties in comparison with the control. The data for the 10% PANI-salt (Examples 15–17) vary substantially.

The electrical conductivity of the fibers was measured by clamping a tow, or bundle of a known number of fibers between two electrodes positioned apart a distance of 0.59 cm and measuring the resistance to current flow. The resistance measurement was then converted to conductivity by using the cross section area of the fiber bundle. The electrical conductivity of the fiber samples was not increased by the addition of the conductive form of polyaniline. Whether the slight decrease shown between the 0%, 1% and 10% polyaniline containing samples is significant is not known.

EXAMPLE 18

This example illustrates the spinning of polyacrylonitrile fibers from a dope containing 20% by wt/wt PANI-salt.

A spinning dope was made up as described in Examples 7–17, but comprising 20% by wt/wt of PANI-salt (60.46 g, of which 48.3% was polyaniline; thus, 29.2 g polyaniline), Acrilan® CP-16 (117.1 g), and DMAC (548.49 g). Fibers were spun from the dope using the same apparatus and procedures as used in examples 7–17, above. The electrical conductivity of annealed fibers from the run was measured as described above to be $1.19\times10^{-7}$ S/cm. Conductivity values for Acrilan® fibers are typically comparable to this. Thus, although the fibers were green in color, indicating the presence of polyaniline in the salt form, the presence of the PANI-salt did not increase the electrical conductivity of the fibers over values typically measured for an acrylic fiber without polyaniline salt.

EXAMPLE 19

This example illustrates the arrangement of the PANI-salt in a fiber by electron micrographs and color computer generated images.

Electron Micrographs:

Transmission electron micrographs were obtained on cross-sections of a fiber from Example 18 and an acrylic control fiber containing no polyaniline. The fibers were embedded in Epo-fix embedding resin which was then polymerized overnight at room temperature. The resulting blocks were then ultramicrotomed into thin sections having a thickness of approximately 80 nm–100 nm. The ultra-thin sections were supported on TEM copper grid and a very thin layer of carbon was coated onto the TEM sample before microscopic observation. A JEOL JSM-2000FX transmission electron microscope with an image resolution of approximately 0.3 nm was used to obtain all micrographs.

Figure 1B:
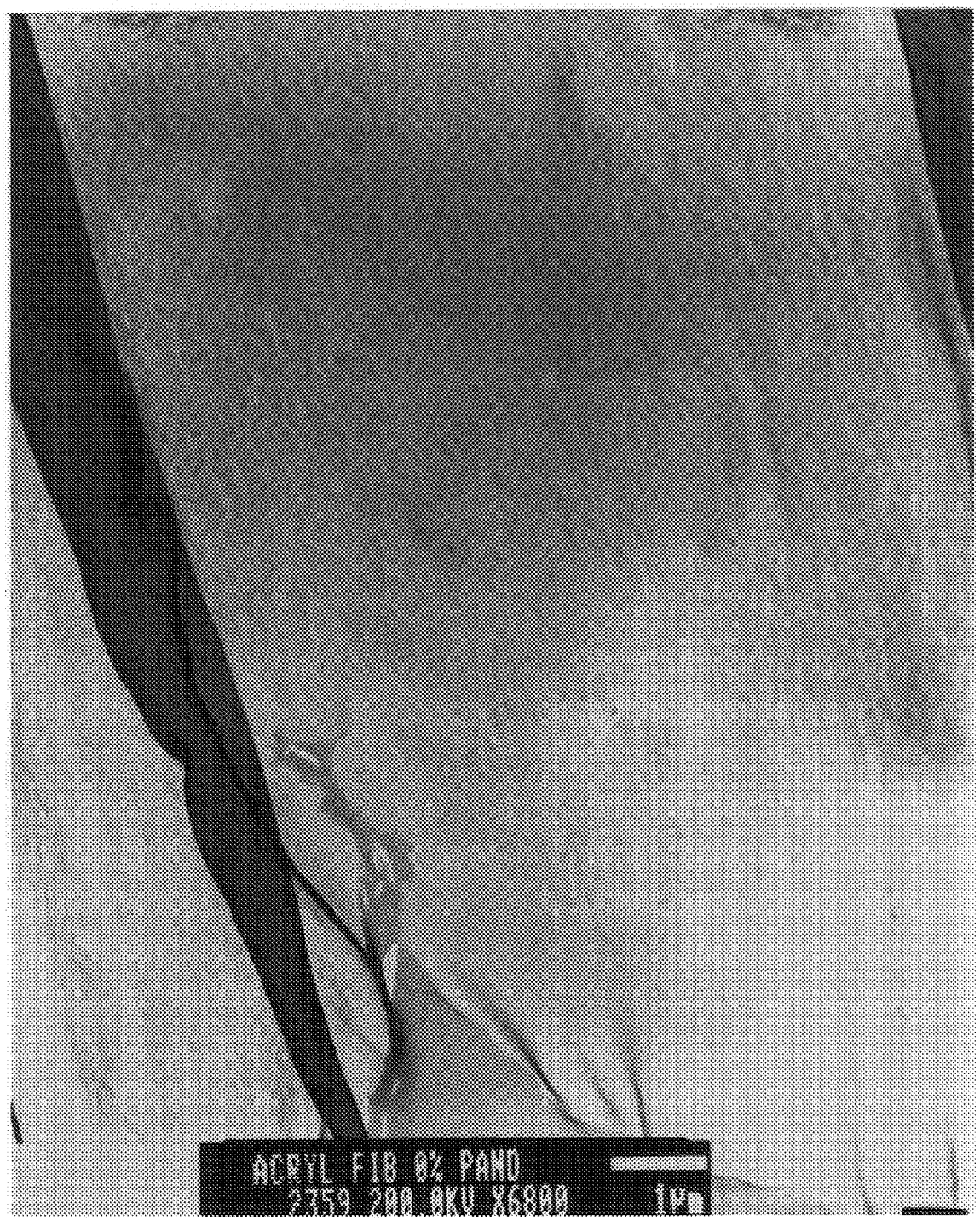
Figure 1C:
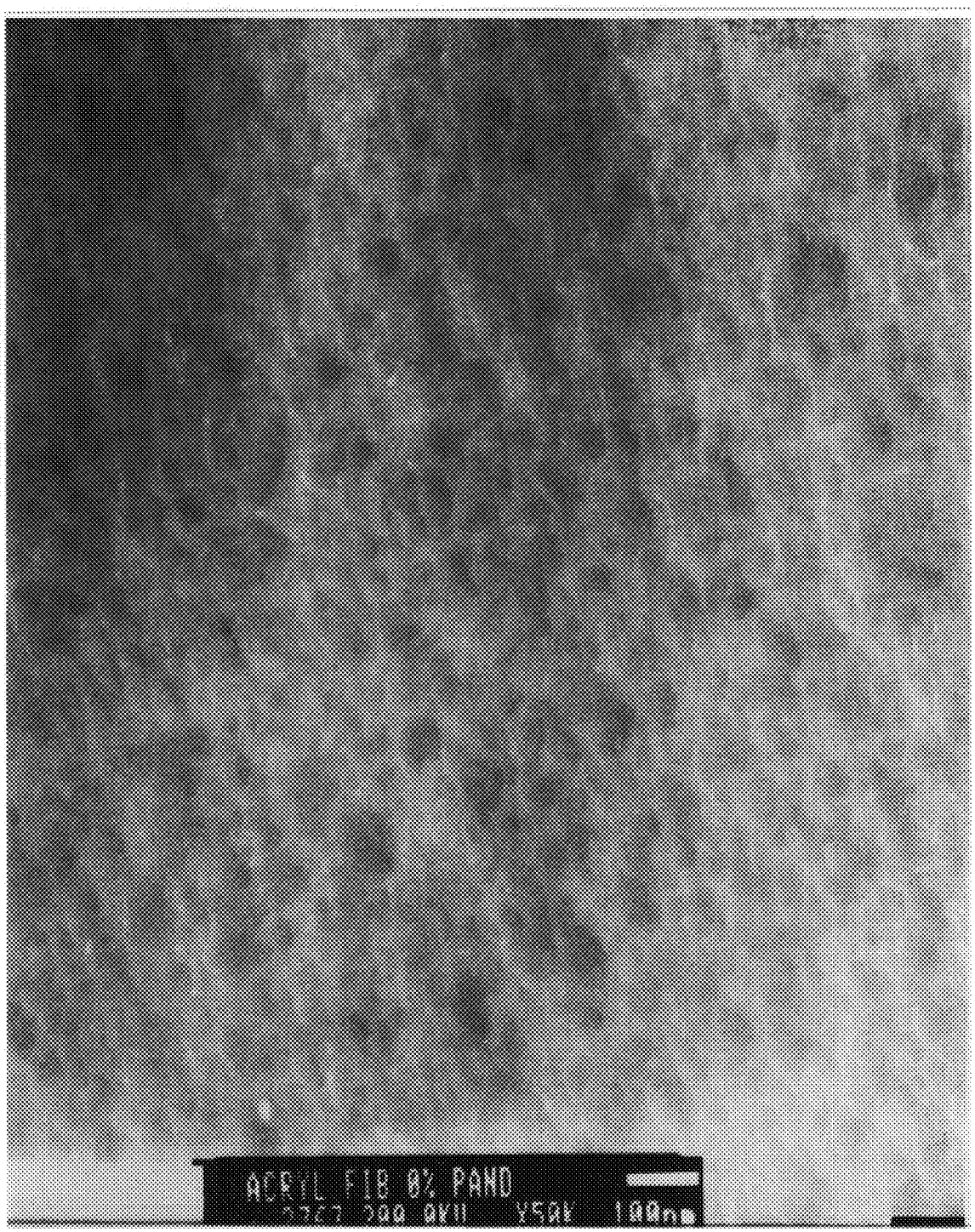

FIGS. 1(*a*), 1(*b*) and 1(*c*) are transmission electron micrographs of cross sections of acrylic fiber containing 0% polyaniline. The original magnification for each photograph and an scale bar are shown on each photograph. Each of the photographs show a uniform cross-section having a relatively homogeneous composition and having no apparent localized concentrations of different mass density.

Figure 2A:
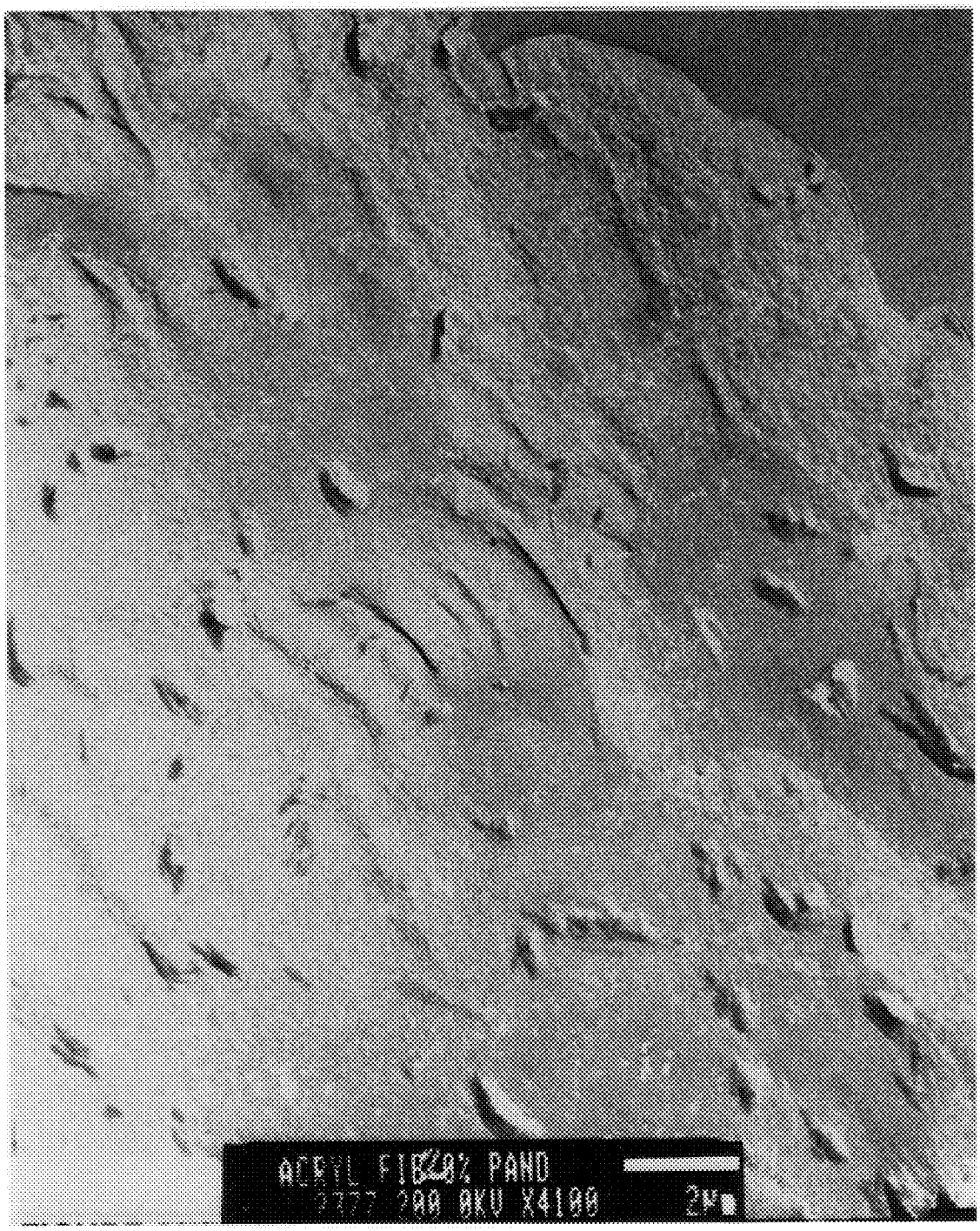
FIG. 2 shows cross-sectional views of a fiber containing a blend of about 20% wt/wt polyaniline salt and about 80% wt/wt Acrilan® using transmission electron microscopy taken at magnifications of, (a) 4100×, (b) 6800×, and (c) 50,000×.
Figure 2B:
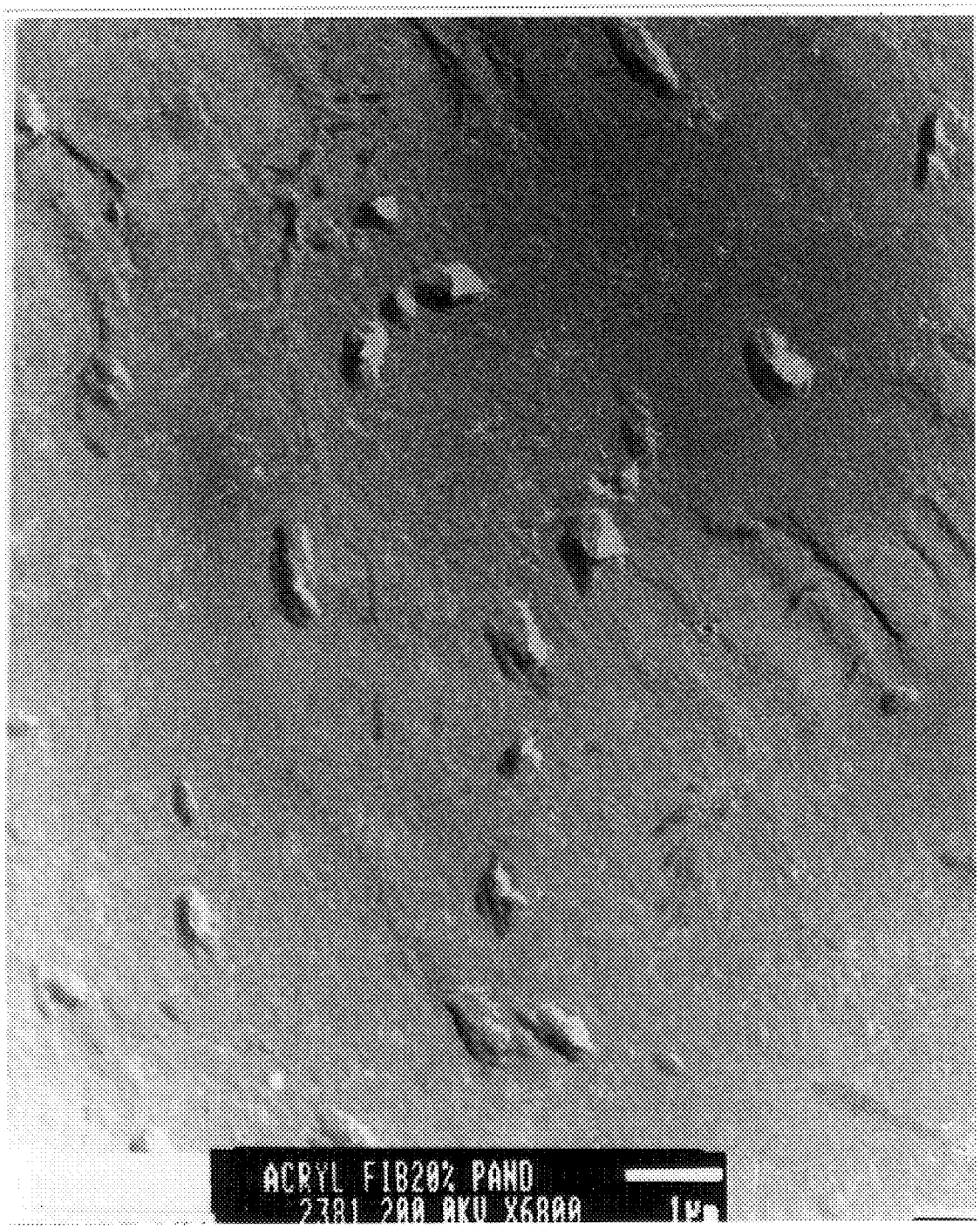
Figure 2C:
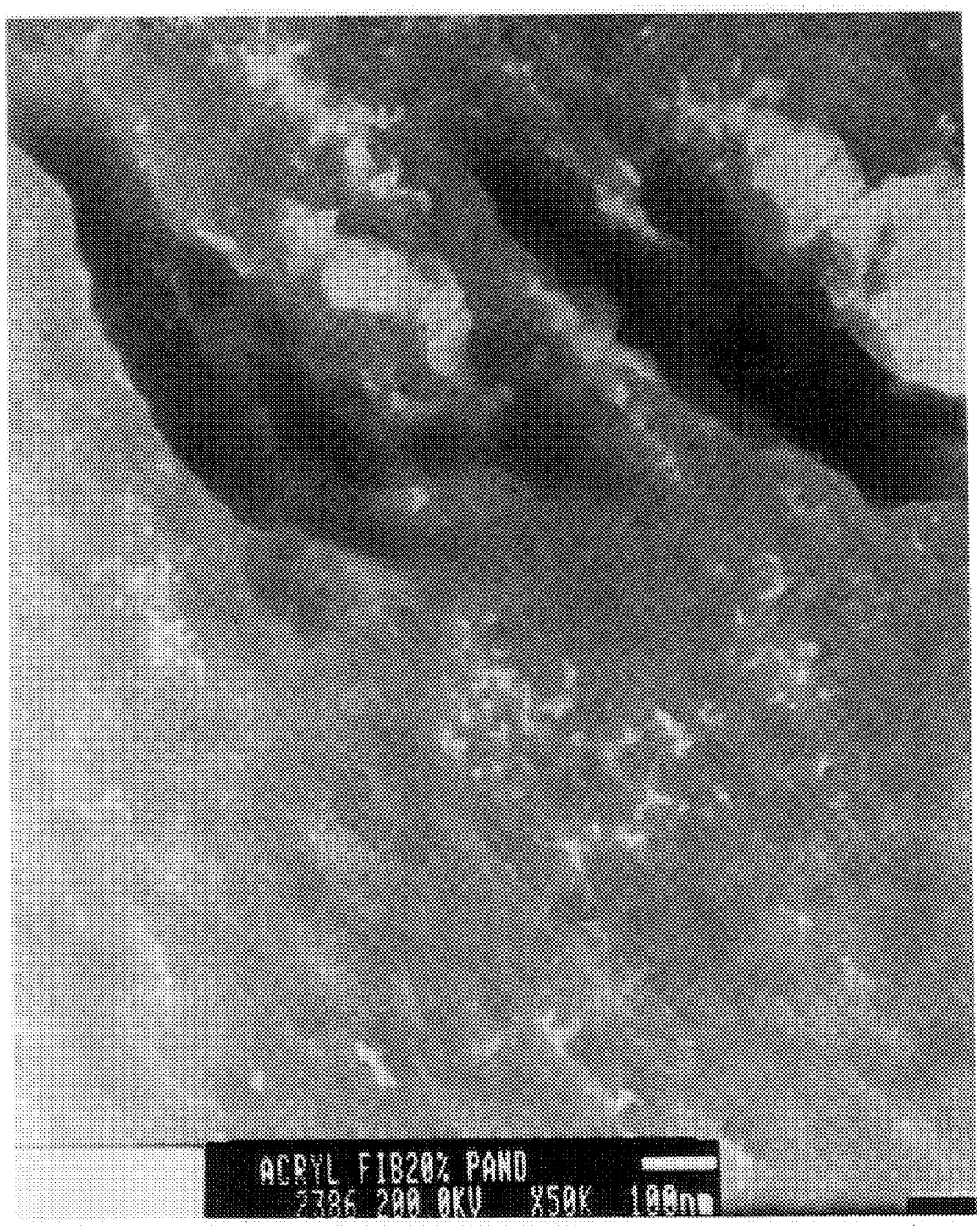

FIGS. 2(*a*), 2(*b*) and 2(*c*) are electron micrographs of cross-sections of acrylic fiber containing 20% polyaniline prepared in Example 18. The original magnifications and scale bars are shown. FIGS. 2(*a*) and 2(*b*) show portions of the fiber cross-section having discrete, non-connected particles, or localized concentrations of material having different mass density than the main component of the fiber. FIG. 2(*c*), taken at greater magnification that 2(*a*) or 2(*b*), includes two of the discrete particles in the field of view.

Color Computer Generated Images:

Samples of fibers were selected from fibers produced in Example 8, having 0% PANI-salt, and Example 18, having 20% wt/wt PANI-salt. Several fibers from each sample were embedded in Epo-fix in flat molds and cross-sectioned at 1 micron thickness. These sections were mounted onto glass slides and examined in bright field mode with an Olympus AX-70 light microscope using a 60x oil immersion objective. Color images were collected digitally using a computer workstation-based imaging system designed by Inovision Corp., Durham, N.C. Images are printed on a 300 dpi dye sublimation printer. Alternatively, the same images could be recorded by photomicrography if desired.

FIG. 3(*a*) is a color computer generated image of cross-sections of an acrylic fiber from Example 8 containing 0% PANI-salt. The fiber has a "kidney", or "bean" shape, typical of Acrilan fibers and has no color or particles in the cross-section. FIG. 3(*b*), however, is the fiber from Example 18 that contains 20% polyaniline. This fiber is from the same tow of fibers that were used for FIG. 2. Here, discrete, non-connected particles can be seen as blue, green, or blue-green particles within a generally transparent matrix. Since the polyaniline salt that was a component of the spinning dope was a highly colored green material, this photograph shows that the discrete, non-connected particles of this fiber sample are polyaniline and the polyaniline particles are dispersed, or distributed, throughout the matrix polymer. The presence of green particles indicates the presence of polyaniline in the salt form.

Figure 4A:
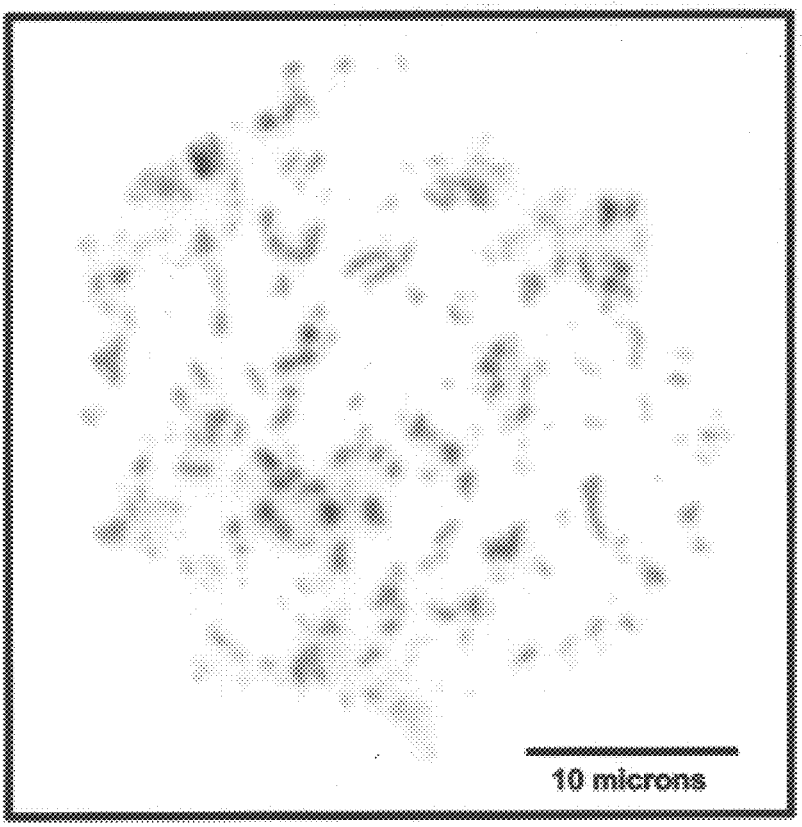
FIG. 4 shows computer generated color image cross-sectional views of fibers containing a blend of about 20% wt/wt polyaniline salt that have been treated respectively in glycerol containing acetic acid, resulting in polyaniline in the green salt form, FIG. 4(*a*), and in glycerol containing triethanolamine, resulting in polyaniline in the blue neutral form, FIG. 4(*b*)
Figure 4B:
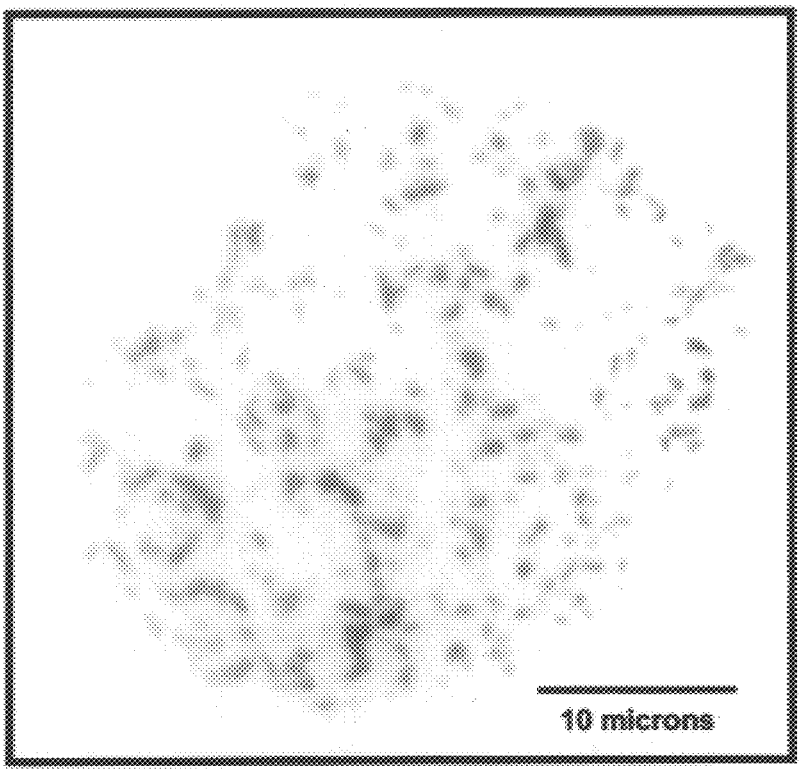

In order to test the validity of use of the color of the computer generated images as an indication of whether the PANI is in the salt or neutral form, thin sections of the fiber of Example 18, containing 20% wt/wt polyaniline salt were mounted in glycerol containing acetic acid and glycerol containing triethanolamine. The presence of acetic acid should protonate the PANI and result in a green color, while the presence of the triethanolamine should deprotonate the PANI and result in a blue color. FIG. 4(*a*) is the PANI and acetic acid and FIG. 4(*b*) is the PANI and triethanolamine. As expected, the polyaniline particles in FIG. 4(*a*) are green in the acidic media and the particles in FIG. 4(*b*) are blue in the basic media. This test verifies the use of blue and green color as an indicator of whether the PANI is in the neutral or salt form.

EXAMPLE 20

Measurement of the level of polyaniline in acrylic/polyaniline fibers.

Thermal analysis was used to determine the level of acrylic polymer in samples of the fibers described in Examples 7–18, above, to which polyaniline had been added at levels of 0%, 1%, 10% and 20% wt/wt and adsorption spectroscopy was used to measure the level of polyaniline in the same samples. These two techniques are complementary. As the polyaniline level increases, the level of acrylic polymer must decrease. In addition, the thermal analysis technique is sensitive to the local environment of the acrylic polymer. Strong interactions between the polyaniline and the acrylic polymer might be expected to be detected.

Thermal Analysis:

A crystalline polymer will melt upon heating, thus giving rise to a melting point. In order to melt the polymer when the temperature reaches the melting point, heat must be added to the polymer as heat of fusion. When the polymer is cooled from the melt, it will crystallize, giving rise to a crystallization point and heat will be released as the heat of crystallization. These quantities are routinely determined with a differential thermal analyzer (e.g., Perkin-Elmer Model DSC-4). Dilution of a polymer having a characteristic heat of fusion and heat of crystallization with other material will result in a reduced heat of fusion and heat of crystallization.

If it is assumed that the level of acrylic polymer in the fibers will be proportional to the heat of fusion and heat of crystallization, the measurement of such heats of phase transition may be used to measure the level of acrylic polymer in the fibers. This technique is described in, Wendtland, W. W., and P. K. Gallagher, Thermal characterization of polymeric material, *Instrumentation*, Ed. E. A. Turi, Academic Press, 1981. With fibers of the present invention, however, one problem must be solved. Acrylic polymers, such as used in the present fibers, do not normally melt upon heating because their thermal decomposition temperature is lower than the melting point. However, it is possible to reduce the melting point below the decomposition temperature by addition of water to the polymer. This approach is described in, Frushour, B. G., *Polymer Bulletin*, 4, 305, 1981, and Frushour, B. G., *Polymer Bulletin*, 7, 1, 1981, which are incorporated herein by reference.

For the fibers of the present invention, the melting point in the presence of excess water is 160° C., and this is achieved at a water content of at least 15%. In this analysis, the level of water was kept at 50% to insure the samples remain in the constant melting point region. Because the melting point is above the normal boiling point of water, the measurement is done in a special high-pressure DSC capsule which can withstand the pressure generated by water vapor.

Determination of thermal parameters for the present fibers was carried out by thoroughly wetting a length of fibers of known weight and sealing the sample in the DSC capsule. The capsule was placed in the Differential Scanning Calorimeter and heated at 10° C./min. through the endotherm at 160° C. and then cooled at the same rate through the exotherm at 137° C. The material was then reheated to generate a second melting endotherm. This was done to remove any effects of processing on the heat of fusion, by reducing the fiber to a standard physical state of melted polymer. The heat of fusion from the second heating run and the heat of crystallization from the first cooling from the melt were determined by integration. These values are shown in the following table:

TABLE 8

| Percent polyaniline in fiber (% wt/wt) | Heat of crystallization (cal./gm) | Second Heat of Fusion (cal./gm) | Crystallization Temp. (° C.) | Second Melting Temperature (° C.) |
|---|---|---|---|---|
| 0% (I.C-3x) | 5.39 | 5.57 | 137.5 | 160.1 |
| 1% (II-A) | 5.34 | 5.54 | 140 | 160.7 |
| 10% (III-B) | 5.01 | 4.92 | 137.5 | 160.4 |
| 20% (V-A) | 4.46 | 4.53 | 137.2 | 160.1 |

Figure 5:
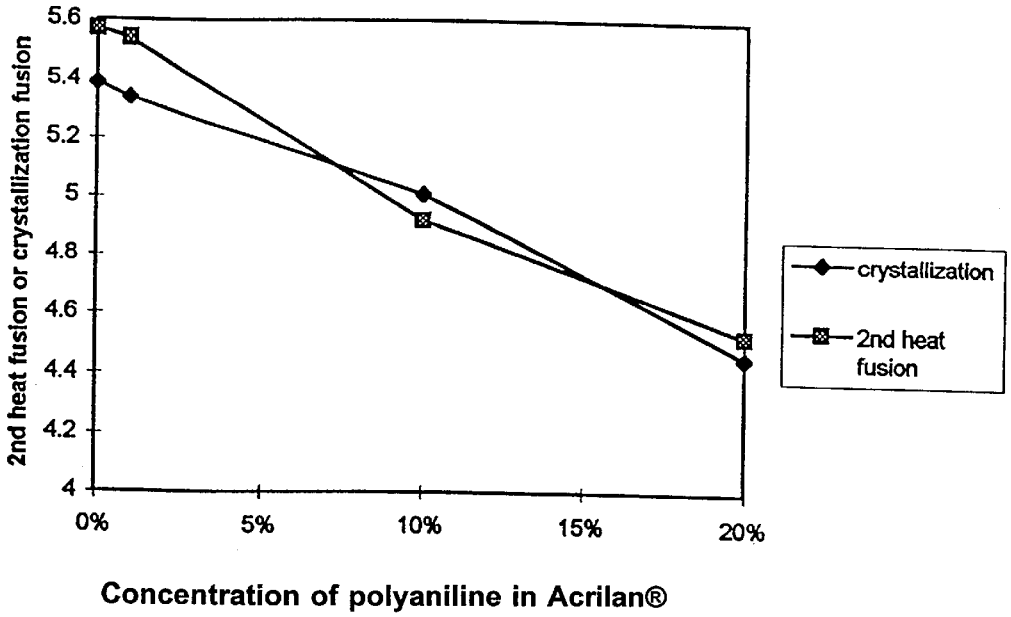
FIG. 5 is a plot of the second heat of fusion and the heat of crystallization obtained by differential scanning calorimetry versus concentration of polyaniline in fibers containing 0%, 1%, 10% and 20% polyaniline by weight in a matrix polymer of Acrilan®.

The heat of crystallization fusion and the second heat of fusion were plotted against the level of polyaniline in the fiber. This plot is shown in FIG. 5. The plot shows a linear decrease in both parameters as the polyaniline level decreases and the values of the heats of fusion and crystallization at 20% polyaniline are 81% and 83%, respectively, of the zero polyaniline control. This indicates that the fibers substantially contain the amount of acrylic polymer expected based on the amount of polyaniline that was added to the spinning dope.

No shift was observed in the melting or crystallization temperatures upon addition of polyaniline, which suggests that there is not a strong interaction between the polyaniline and the acrylic polymer.

Figure 6:
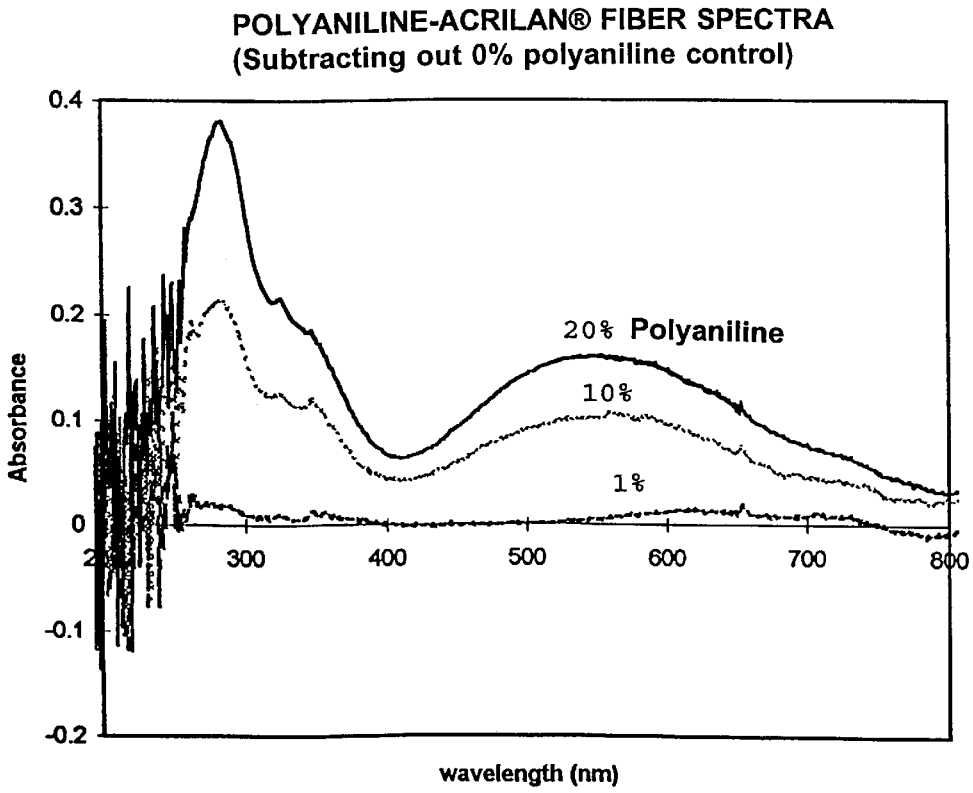
FIG. 6 is a plot titled, Polyaniline-Acrilan® Fiber Spectra, and shows the absorption spectra of Acrilan® fibers containing 1%, 10% and 20% polyaniline in NMP solution over a wavelength span of about 200 nm to about 800 nm, the spectra have been corrected for the 0% polyaniline spectra, and show a peak characteristic of polyaniline in NMP at about 545 nm.
Figure 7:
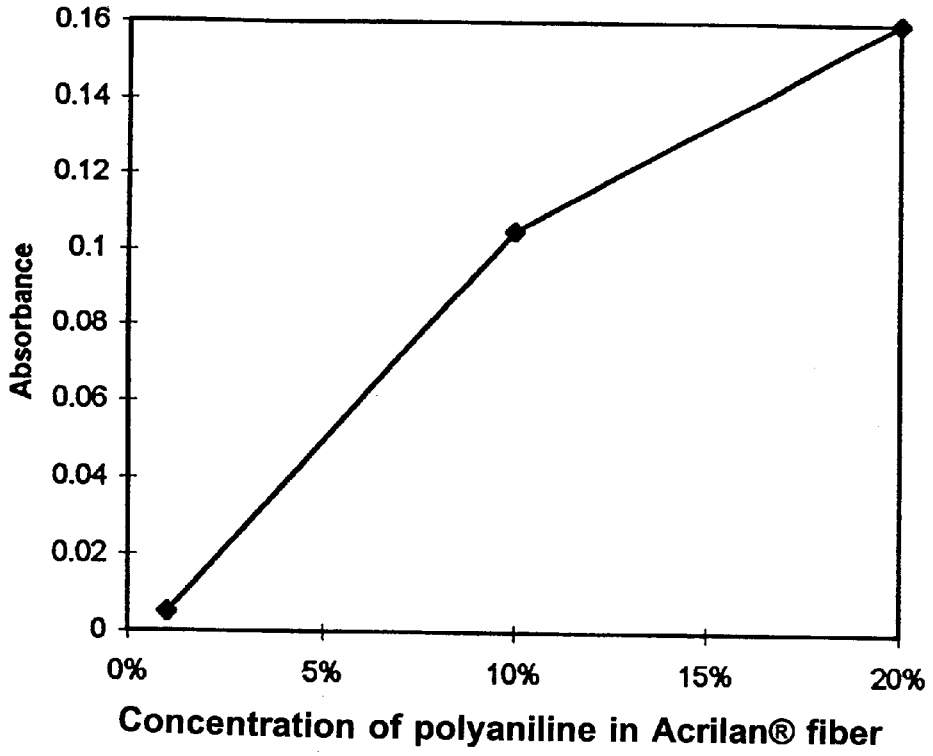
FIG. 7 shows the substantially linear plot of the absorbance at 545 nm for each of the spectra shown in FIG. 4, versus the level of polyaniline in the Acrilan® fiber.

Absorption Spectroscopy:

When polyaniline salt is placed in solution in N-methyl pyrrolidone (NMP), it changes color from green to blue and the solution adsorbs strongly at a wavelength of 545 nanometers. NMP solutions that contained 1% wt/wt fiber solids were prepared by dissolving appropriate amounts of the same fibers as used above in the thermal analysis experiments in NMP. NMP solutions were made with fibers containing 0% (sample I.C-3x), 1% (sample II-A), 10% (sample III-B) and 20% (sample V-A) polyaniline in acrylic polymer and absorbance were measured by a Perkin-Elmer UV-Vis LAMBA 6 spectrophotometer and the spectrum of the control (the 0% polyaniline sample) was subtracted. These corrected absorbances should be proportional to the level of polyaniline added to the fiber. Absorbance for the corrected spectra was plotted, as shown in FIG. 6, over a wavelength span of about 200 nm–800 nm. The absorbance at 545 nm for each of the fiber samples was then plotted vs. the amount of polyaniline that had been added to each fiber. That plot is shown in FIG. 7 and indicates an approximately linear relationship over the range of polyaniline tested.

Thus, both the thermal analysis and the absorbance tests indicate that the fibers of the present invention substantially contained the level of polyaniline to be expected based on the amount of polyaniline that had been added to the respective spinning dopes.

EXAMPLE 21

This example illustrates the spinning of fibers containing VERSICON ICP® polyaniline.

A spinning solution of 12.5% wt/wt Acrilan® CP-16 was prepared in dimethylformamide (DMF). (Acrilan® CP-16 is a copolymer containing over at least 85% wt/wt polyacrylonitrile which is available from Monsanto Company). VERSICON ICP® (polyaniline doped with p-toluenesulfonic acid and rinsed with a solution containing dodecylbenzenesulfonic acid, available from Monsanto Company) was added to portions of the dope to prepare VERSICON®/CP-16 solutions containing the following concentrations of VERSICON® (as weight percent of total solids): 0.31, 1.45, 6.01, 11.21, and 36.0. Fibers were prepared from the spinning solutions by spinning into a 50:50 DMF/water solution (gel bath, or coagulation bath) from a 5 ml syringe. The resulting fibers were blue in color (the blue color is due to the non-conductive emeraldine base form of the polyaniline), indicating the failure of the polyaniline to remain in the doped, or emeraldine salt form through the wet-spinning process. The fibers had a resistance of over $10^{11}$ ohms as measured with a Beckman MegOhm meter, which showed that they did not conduct electricity.

In view of the above, it will be seen that the several advantages of the invention are achieved and other advantageous results attained.

As various changes could be made in the above methods and compositions without departing from the scope of the invention, it is intended that all matter contained in the above description shall be interpreted as illustrative and not in a limiting sense.

What is claimed:

1. A fiber containing an intrinsically conductive polymer comprising an organic acid salt of an intrinsically conductive polymer dispersed in a matrix polymer.

2. A fiber according to claim 1 comprising an electrically conductive organic acid salt of an intrinsically conductive polymer wherein the fiber is electrically non-conductive.

3. A fiber according to claim 2 wherein the organic acid salt of an intrinsically conductive polymer has a conductivity greater than $10^{-5}$ S/cm.

4. A fiber according to claim 1 wherein the intrinsically conductive polymer is polyaniline.

5. A fiber according to claim 4 wherein contains from about 1 to about 40 percent (w/w) of the organic acid salt of polyaniline dispersed in the matrix polymer.

6. A fiber according to claim 4 wherein the organic acid is dinonylnaphthalene sulfonic acid.

7. A fiber according to claim 6 wherein the fiber has a conductivity less than $10^{-5}$ Siemen/cm.

8. A fiber according to claim 1 wherein the matrix polymer is selected from cellulose acetate, cellulose triacetate, cellulose (viscose), polyacrylonitrile, polyamides, polyesters, polyolefins, polyurethanes, or polyvinyl chloride.

9. A fiber according to claim 8 wherein the matrix polymer is polyacrylonitrile.

10. A fiber according to claim 9 wherein the tenacity of the fiber is equal to or greater than about 1.0 g/denier.

11. A fiber containing an intrinsically conductive polymer prepared by a process comprising:

a. mixing in a spinning solution an organic acid salt of an intrinsically conductive polymer, a matrix polymer and an organic solvent; and b. extruding the spinning solution from a spinneret into a coagulation bath containing a nonsolvent wherein the nonsolvent is comprised of a liquid in which the matrix polymer and the organic acid salt of the intrinsically conductive polymer are substantially insoluble, thereby forming a fiber having an organic acid salt of an intrinsically conductive polymer dispersed throughout the matrix polymer.

* * * * *